US007232242B2

(12) United States Patent
Isoda et al.

(10) Patent No.: US 7,232,242 B2
(45) Date of Patent: Jun. 19, 2007

(54) LAMP HOLDER FOR LAMP WITH A SINGLE BASE AND LIGHTING APPARATUS USING THE SAME

(75) Inventors: Masaaki Isoda, Hirakata (JP); Tomoyuki Ono, Soraku-gun (JP)

(73) Assignees: Matsushita Electric Works, Ltd., Osaka (JP); Asahi Matsushita Electric Works, Ltd., Osaka (JP)

( * ) Notice: Subject to any disclaimer, the term of this patent is extended or adjusted under 35 U.S.C. 154(b) by 184 days.

(21) Appl. No.: 11/098,468

(22) Filed: Apr. 5, 2005

(65) Prior Publication Data

US 2005/0231963 A1 Oct. 20, 2005

(30) Foreign Application Priority Data

Apr. 16, 2004 (JP) ..... 2004-121803
Apr. 16, 2004 (JP) ..... 2004-121804

(51) Int. Cl.
*F21V 21/00* (2006.01)

(52) U.S. Cl. ..... 362/429; 362/440

(58) Field of Classification Search ..... 362/429–430, 362/440–441, 444; 439/333–336
See application file for complete search history.

(56) References Cited

U.S. PATENT DOCUMENTS 5,087,213 A * 2/1992 Drapcho et al. ..... 439/672
5,186,535 A * 2/1993 Yokoyama ..... 362/649
5,593,324 A * 1/1997 Ito ..... 439/672
5,823,806 A 10/1998 Nagase et al.

FOREIGN PATENT DOCUMENTS

JP 2001-093631 4/2001

OTHER PUBLICATIONS

English Language abstract of JP 2001-93631.

* cited by examiner

*Primary Examiner*—Thomas M. Sember
*Assistant Examiner*—Julie A. Shallenberger
(74) *Attorney, Agent, or Firm*—Greenblum & Bernstein, P.L.C.

(57) ABSTRACT

A lamp with a single base is mounted on a lamp holder by processes of contacting a second mounting face of the base with a first mounting face of the lamp holder and turning the base in a first turning direction with respect to the lamp holder. A plurality of engaging projections is formed on the lamp holder with which a plurality of engaging protrusions of the base is engaged, when the base is turned in a first turning direction. A pair of hooking receivers is formed on a mounting face of the lamp holder so as to be hooked with a hooking protrusion of the base. A pair of lamp holding springs is provided on the lamp holder for applying forces for restricting turning of the base in a second turning direction opposite to the first turning direction under a condition that the second hooking portion of the base is hooked with the first hooking portion. Thus, safety and reliability of mounting of the lamp on the lamp holder can be increased.

18 Claims, 20 Drawing Sheets

10
1
33
40
12
11
34
16a
20
41
19
16
3
3c
3b
3a
2
2a
9
7
8
8b
8a
6
5
5a
4
17
17a
17b
30
32
15
14
13
1a

LAMP HOLDER FOR LAMP WITH A SINGLE BASE AND LIGHTING APPARATUS USING THE SAME

BACKGROUND OF THE INVENTION

1. Field of the Invention

The present invention relates to a lamp holder for a lamp with a single base, and especially relates to a bayonet-type lamp holder for a high brightness and large-scale size of a lamp such as a fluorescent lamp with a single base.

2. Description of the Related Art

In recent years, the high output and large-scale size of a fluorescent lamp having a single base is used as a substitute light source of an HID lamp, and it is necessary therefore to be able to improve certainty of lamp holding.

In the conventional HID lamp generally, screw-type base and lamp holder are used, so that the HID lamp is turned a lot when it is mounted on a lamp holder. Thus, there was very little possibility that the lamp fell to even if clamping of the lamp was a little loose.

On the other hand, a fluorescent lamp with a single base conventionally has a bayonet-type mount, in which protrusions of the base of the fluorescent lamp are fitted to recesses of a lamp holder and the base of the lamp is rotated with respect to the lamp holder, so that the protrusions of the base of the lamp are engaged with hooks of the lamp holder.

A conventional bayonet-type lamp holder and a base of a lamp are described with reference to FIGS. 18A, 18B, 19A and 19B. FIGS. 18A and 18B show a configuration of a conventional lamp holder 100. FIGS. 19A and 19B show a configuration of a conventional base of a lamp.

As can be seen from figures, the lamp holder 100 has a circular recess 101 formed at substantially center portion of a first mounting face 100*a* and four projections 104 formed at side faces thereof for projecting outward. The base 102 has a cylindrical protrusion 103 formed at substantially center of a second mounting face 102*a* and four engaging protrusions 106 formed at periphery portions of the second mounting face 102*a* for protruding upward. The cylindrical protrusion 103 of the base 102 is inserted into the circular recess 101 of the lamp holder 100. Each engaging protrusion 106 of the base 102 has an engaging groove 105 with which the projections 104 of the lamp holder 100 is engaged.

The lamp holder 100 further has a pair of hooking recesses 107, and the base 102 has a pair of hooking protrusions 108 to be hooked with the hooking recesses 107. The hooking protrusions 108 are formed on spring portions 109 which are formed on the second mounting face 102*a* of the base 102 and elastically deformed. The spring portions 109 are normally formed of a resin material integrally with the base 102.

The lamp holder 100 still further has two pairs of jack holes 110 and a pair of protrusions 112 formed on an inner face of the circular recess 101 and used for distinguishing wattage of the lamp. The base 102 still further has two pairs of pins 111 to be contacted with lamp terminals disposed below the jack holes 110 and a pair of grooves 113 formed on an outer face of the cylindrical protrusion 103 and engaged with the protrusions 112.

For coupling the base 102 with the lamp holder 100, the base 102 is placed to face the lamp holder 100 in a manner so that the second mounting face 102*a* of the base 102 contacts the first mounting face 100*a* of the lamp holder 100 and the cylindrical protrusion 103 of the base 102 is inserted into the circular recess 101 of the lamp holder 100, but the engaging protrusions 106 of the base 102 do not interfere with the projections 104 of the lamp holder 100. Under such a state, when the lamp with the base 102 is turned in a first turning direction around a center axis of the cylindrical protrusion 103 or the circular recess 101, the engaging grooves 105 of the engaging protrusions 106 of the base 102 are engaged with the projections 104 of the lamp holder 100. Dismounting of the base 102 from the lamp holder 100 due to turning in a second turning direction opposite to the first turning direction is prevented owing to the hooking of the hooking protrusions 108 with the hooking recesses 107.

In Publication gazette of Japanese Patent Application 2001-93631, an elastic hooking protrusion is formed on each groove 105 of the engaging protrusion 106 of the base 102 to be hooked with the projection 104 of the lamp holder 100, instead of the hooking recesses 107, the hooking protrusions 108 and the spring portions 109.

In the above-mentioned conventional bayonet-type lamp holder and the base of the lamp, in order to improve click feeling when the base of the lamp is mounted on or dismounted from the lamp holder, it is proposed to increase the elastic reaction force of the spring portion 109 or the elastic hooking protrusion. It, however, becomes easily be broken due to increasing of stress in the spring portion 109 or the elastic hooking protrusion. Furthermore, the resin material of the lamp holder 100 and the base 102 will be deteriorated while they are used in long term under high temperature condition. If the hooking protrusion 108 is broken due to the above-mentioned reason, the base 102 of the lamp is held on the lamp holder 100 only owing to the friction between the pins 111 and the lamp terminals. Since various vibrations including micro-vibration are applied to the lamp holder 100 and the base 102 of the lamp while the long use, the base 102 of the lamp is gradually loosened with respect to the lamp holder 100, and there is a possibility that the lamp falls to.

Furthermore, even if the base 102 of the lamp was engaged betwixt and between with the lamp holder 100, the lamp could be held on the lamp holder 100. Then, there was a possibility that the lamp fell to due to vibration or the like while the mounting of the lamp or while the use of the lamp.

Since the size of the lamp with a single base is upsized in recent years, the falling of the lamp is serious problem.

SUMMARY OF THE INVENTION

A purpose of the present invention is to provide a lamp holder for a lamp with a single base in which safety and reliability of mounting the lamp on the lamp holder are increased, and to provide a lighting apparatus using the same.

In a lamp holder for a lamp with a single base in accordance with an aspect of the present invention, the base of the lamp is mounted on the lamp holder by processes of contacting a second mounting face of the base with a first mounting face of the lamp holder and turning the base in a first turning direction with respect to the lamp holder.

The lamp holder comprises a plurality of first engaging portions with which a plurality of second engaging portions of the base is engaged so as not to be dismounted in a direction perpendicular to the first and second mounting faces, when the base is turned in the first turning direction; at least a first hooking portion with which at least a second hooking portion of the base is detachably hooked, when the base is turned at a predetermined angle in the first turning direction; and at least a lamp holding spring for applying a force for restricting turning of the base in a second turning direction opposite to the first turning direction under a condition that the second hooking portion of the base is hooked with the first hooking portion.

A lighting apparatus in accordance an aspect of the present invention is configured by at least a lamp holder and a lamp with a single base mounted on the lamp holder.

The lamp holder comprises a first mounting face, a plurality of first engaging portions, at least a first hooking portion, and at least a lamp holding spring.

The base of the lamp comprises a second mounting face, a plurality of second engaging portions engaged with the first engaging portions of the lamp holder when the base is turned in a first turning direction, and at least a second hooking portion detachably hooked with the first hooking portion of the lamp holder so as not to be dismounted in a direction perpendicular to the first and second mounting faces when base is turned at a predetermined angle in the first turning direction.

The lamp holding spring applies a force for restricting turning of the base in a second turning direction opposite to the first turning direction under a condition that the second hooking portion of the base is hooked with the first hooking portion.

By such a configuration, the base of the lamp is held on the lamp holder owing to not only the hooking of the first hooking portion of the lamp holder with the second hooking portion of the base of the lamp but also the pressing force of the lamp holding spring applied to the second engaging portion of the base. Thus, it is difficult to turn the base of the lamp easily in the second turning direction with respect to the lamp holder. Even if the first and/or second hooking portion(s) is(are) damaged by vibrations or impacts, the turning of the base of the lamp is restricted owing to the pressing force of the lamp holding spring, so that the lamp rarely falls. The safety and reliability of mounting the lamp on the lamp holder can be increased.

DETAILED DESCRIPTION OF THE EMBODIMENT

First Embodiment

Figures 1A, 1B:
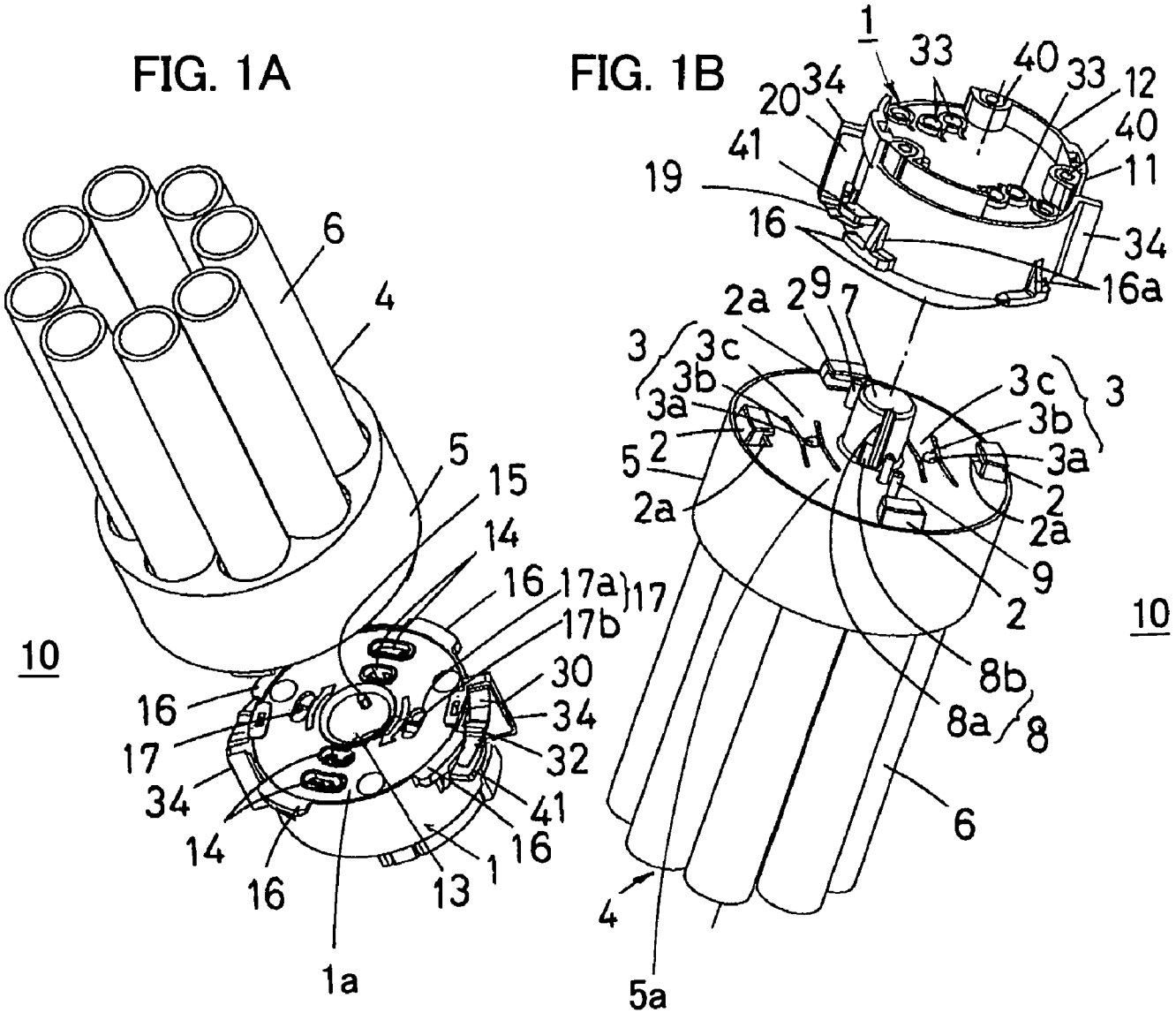
FIG. 1A is a perspective view showing configurations of a lamp holder and a fluorescent lamp with a single base in accordance with a first embodiment of the present invention, which is illustrated especially for showing a mounting face of the lamp holder.
FIG. 1B is a perspective view showing configurations of the lamp holder and the fluorescent lamp in the first embodiment, which is illustrated from another direction especially for showing a mounting face of the base of the lamp and a rear face of the lamp holder.
Figure 2:
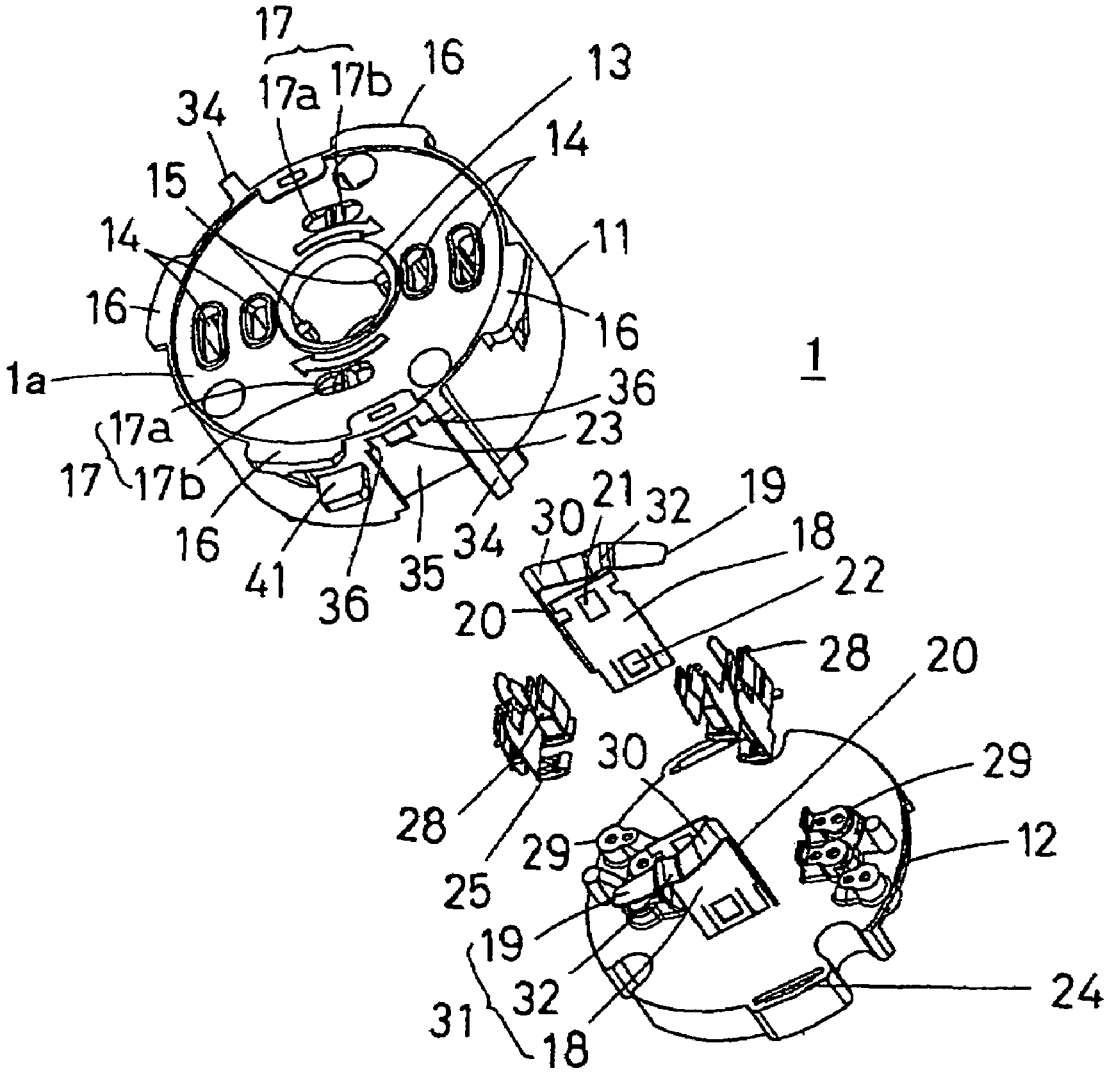
FIG. 2 is an exploded perspective view showing a configuration of the lamp holder in the first embodiment.
Figure 3:
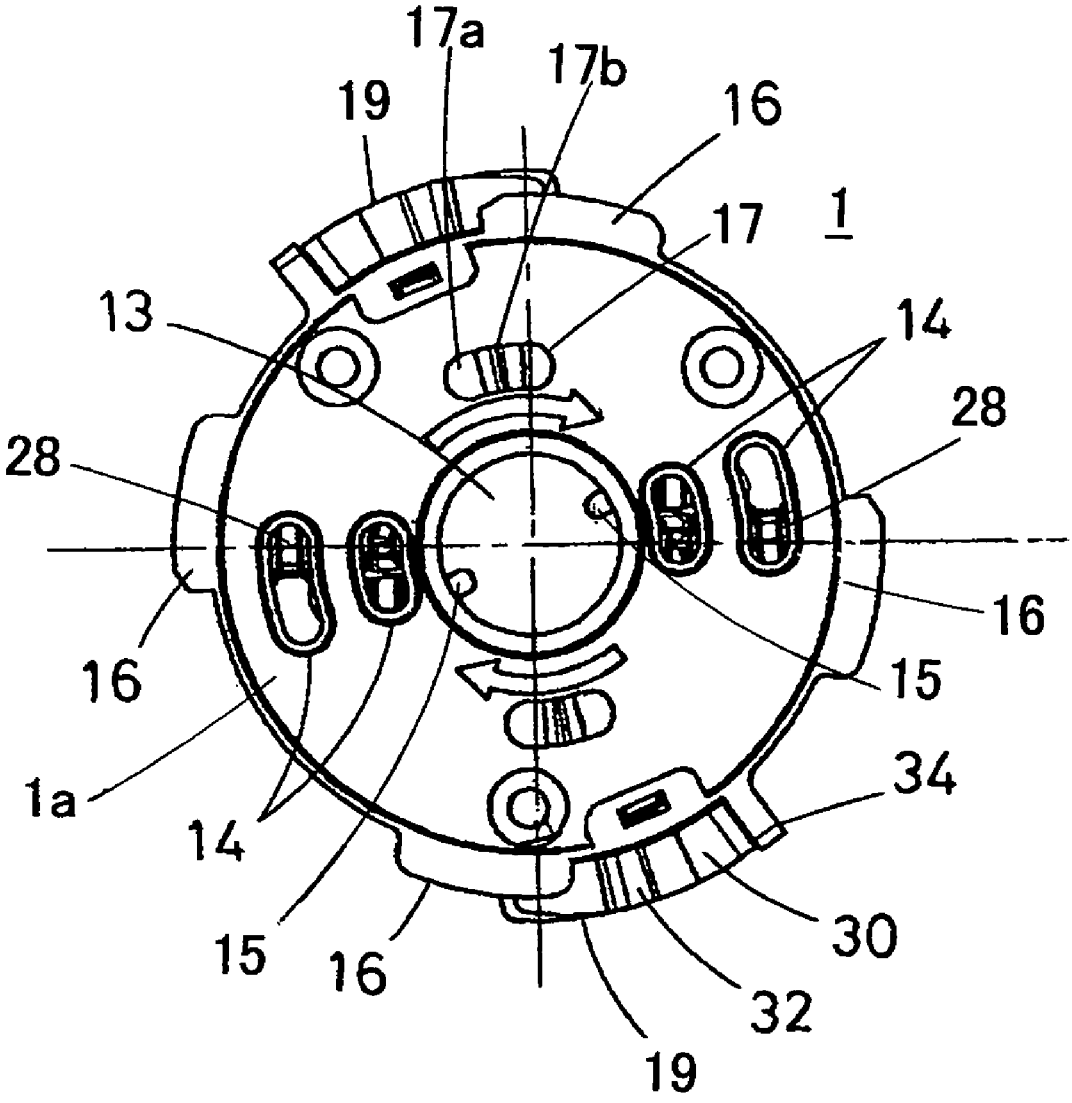
FIG. 3 is a plan view of the lamp holder in the first embodiment.

A lamp holder for a lamp with a single base and a lighting apparatus using the same in accordance with a first embodiment of the present invention is described with reference to figures. FIG. 1A shows the configurations of the lamp 4 with the base 5 and the lamp holder 1 illustrated from a direction, and FIG. 1B shows the lamp 4 with the base 5 and the lamp holder 1 illustrated from another direction. FIG. 2 shows an inner configuration of the lamp holder 1. FIG. 3 shows a front view of the lamp holder 1.

The lighting apparatus 10 comprises at least the lamp holder 1 and the lamp 4 with a single base 5. The lamp holder 1 and the base 5 of the lamp 4 have bayonet-type mounting structures, in which the base 5 is turned at a predetermined angle with respect to the lamp holder 1 under a state that a second mounting face 5*a* the base 5 contacts with a first mounting face 1*a* of the lamp holder 1.

Detailed configuration of the lamp 4 is described first. As can be seen from FIGS. 1A and 1B, the lamp 4 has the base 5 having a cylindrical shape and made of a resin material, and a lamp bulb 6. The lamp bulb 6 is configured by, for example, eight cylindrical tubes, and mounted on the base 5. The base 5 has a cylindrical protrusion 7 at substantially the center of the second mounting face 5*a*.

A pair of L-shaped grooves 8, each configured by a first groove 8*a* formed along a center axis of the cylindrical protrusion 7 and used for guiding insertion operation of the cylindrical protrusion 7 into a circular recess 13 of the lamp holder 1 and a second groove 8*b* used for guiding rotation of the base 5 with respect to the lamp holder 1 around the center axis of the cylindrical protrusion 7 or the circular recess 13, is formed on an outer face (second cylindrical face) of the cylindrical protrusion 7. The L-shaped grooves 8 are further used for distinguishing wattage of the lamp 4.

Two pairs of pins 9 connected to filaments in the bulb 6 are arranged symmetrical on a line with respect to the center axis of the cylindrical protrusion 7 for protruding outward from the second mounting face 5*a*. Four engaging protrusions (second engaging portions) 2 are formed at four positions, two of which are on the same line of the pins 9 and the rest two are on a line crossing at right angle with the line of the pins 9, in the vicinity of outer periphery of the second mounting face 5*a* of the base 5. Each engaging protrusion 2 is formed for protruding outward from the second mounting face 5*a* and have an engaging groove 2*a* which is opened to an inner face and a side face of the engaging protrusion 2.

A pair of hooking portions (second hooking portions) 3 is formed on the second mounting face 5*a* between the cylindrical protrusion 7 and the engaging protrusions 2 on the line crossing at right angle with the line of the pins 9. Each hooking portion 3 is configured to have a hooking protrusion 3*a* and a spring portion 3*c* that can be elastically deformed due to a pair of slits 3*b* formed on both sides of the hooking protrusion 3*a*. The hooking portions 3 are integrally formed of the resin material with the base 5. The spring portions 3*c* apply the elastic forces to the engaging protrusions 3*a* in the protruding direction.

Subsequently, detailed configuration of the lamp holder 1 is described. As can be seen from FIG. 2, the lamp holder 1 is configured to have a body 11, which has an opening at an opposite end of the mounting face 1*a*, and a cover 12 for sealing the opening of the body 11. The body 11 has a substantially cylindrical shape having a diameter smaller than that of the base 2 of the lamp 4.

The body 11 has the above-mentioned circular recess 13 at a center of the first mounting face 1*a* thereof, into which the cylindrical protrusion 7 of the base 2 is inserted. The body 11 further has two pairs of jack holes 14 arranged on both sides of the circular recess 13, into which the pins 9 of the lamp 4 are inserted. Each jack hole 14 has an arc shape. A pair of protrusions 15 used for distinguishing wattage of the lamp 4, which will be guided by the L-shaped groove 8 on the cylindrical protrusion 7, is formed on an inner face (first cylindrical face) of the circular recess 13. In case that the wattage of the lamp 4 coincides with the wattage of the lamp holder 1, each protrusion 15 is guided into the first groove 8*a* of the L-shaped groove 8, when the cylindrical protrusion 7 of the base 5 of the lamp 4 is inserted into the circular recess 13 of the lamp holder 1. Subsequently, the protrusion 15 is guided into the second groove 8*b* of the L-shaped groove 8 when the base 5 of the lamp 4 is turned with respect to the lamp holder 1.

Four engaging projections 16, which are to be engaged with the engaging grooves 2*a* of the engaging protrusions 2 of the base 5, are formed for projecting outward from cylindrical outer face of the body 11. A reinforcing rib 16*a* is formed between the outer face of the body 11 and a rear face of each engaging projection 16. When the base 5 of the lamp 4 is turned at a predetermined angle with respect to the lamp holder 1 under the state that the second mounting face 5*a* the base 5 contacts the first mounting face 1*a* of the lamp holder 1, the engaging projections 16 are engaged with the engaging grooves 2*a* of the engaging protrusions 2. Thus, the engaging protrusions 2 of the base 5 are hooked in an insertion direction of the cylindrical protrusion 7 of the base 5 into the circular recess 13 of the lamp holder 1.

A pair of hooking receivers (first hooking portions) 17 is formed on the first mounting face 1*a* of the lamp holder 1 at positions corresponding to the hooking portions 3 of the base 5 of the lamp 4. Each hooking receiver 17 has a hole 17*a* long aside and a protrusion 17*b* formed at substantially the center of the hole 17*a*. When the base 5 of the lamp 4 is turned in a first turning direction with respect to the lamp holder 1, the hooking protrusion 3*a* of the hooking portion 3 climbs over the protrusion 17*b* in the hole 17*a* of the hooking receiver 17 owing to elastic deformation of the spring portion 3*c*. Thus, the turning of the base 5 of the lamp 4 in a second turning direction opposite to the first turning direction is restricted due to hooking of the protrusions 3*a* and 17*b*.

The turning of the base 5 of the lamp 4 is stopped when a front end of the engaging projection 16 in the first turning direction contacts a closed end of the engaging groove 2*a* or when an end face of the engaging protrusion 2 contacts the reinforcing rib 16*a*.

As can be seen from FIG. 2, the cover 12 has a pair of base protrusions 29. Furthermore, as can be seen from FIG. 1B, the cover 12 has a pair of wire insertion holes 33. A pair of lamp terminals 28 is respectively mounted on the base protrusions 29, which is contained in an inner space of the body 11. Each lamp terminal 28 has a pair of quick fastening terminals 25 to which wires inserted through the wire insertion holes 33 are connected. Under a condition that the opening of the body 11 is sealed by the cover 12, each lamp terminal 28 is disposed to face each pair of jack holes 14, so that the pins 9 inserted through the jack holes 14 are clipped on the lamp terminal 28 and electrically connected to the wires.

A pair of couplers 31 with a cantilever spring 19 is provided on the cover 12 at positions on a line crossing at right angle with an arrangement of the base protrusions 29, and in the vicinity of the rear end the engaging projections 16 in the first turning direction for mounting the base 5 of the lamp 4 on the lamp holder 1. Each coupler 31 is made of a thin metal plate having a sufficient elasticity to serve as a plate spring. The coupler 31 has a base plate 18, a standing portion 20 which is bent at right angle with respect to a side of the base plate 18, and a tongue shaped cantilever spring 19 which is further bent at a predetermined angle near to the right angle with respect to the standing portion 20 along a front end of the base plate 18. A stepped portion serving as a lamp holding spring portion 32 is formed at substantially the center of the cantilever spring 19. The base plate 18 of the coupler 31 has a pair of plate spring portions 21 and 22, which are formed by cutting the base plate 18 like substantially horseshoe shapes and bending toward the opposite direction to the standing portion 20.

A pair of slits 24 is formed on the cover 12 at positions near to outer periphery thereof, into which a rear end of the base plate 18 of the coupler 31 are inserted. When the rear end of the base plate 18 of the coupler 31 is inserted into the slit 24, the plate spring portion 22 is elastically deformed and contacts side faces of the slit 24, so that the coupler 31 is held on the cover 12.

A pair of concave portions 35 is formed on the cylindrical outer face of the body 11, into which the base plate 18 of the coupler 31 are contained. A guide wall 34 is formed along a side of each concave portion 35 for guiding the standing portion 20 of the coupler 31 so as not to depart the cantilever spring 19 from the outer face of the body 11. A pair of grooves 36 is formed on rear end of both sides of the concave portion 35, into which portions of side faces in the vicinity of the front end of the base plate 18 of the coupler 31 are engaged. Furthermore, a recess 23, to which the plate spring portion 21 of the base plate 18 of the coupler 31 is fitted, is formed on the concave portion 35. The base plate 18 of the coupler 31 couples the body 11 and the cover 12 integrally.

Figure 4B:
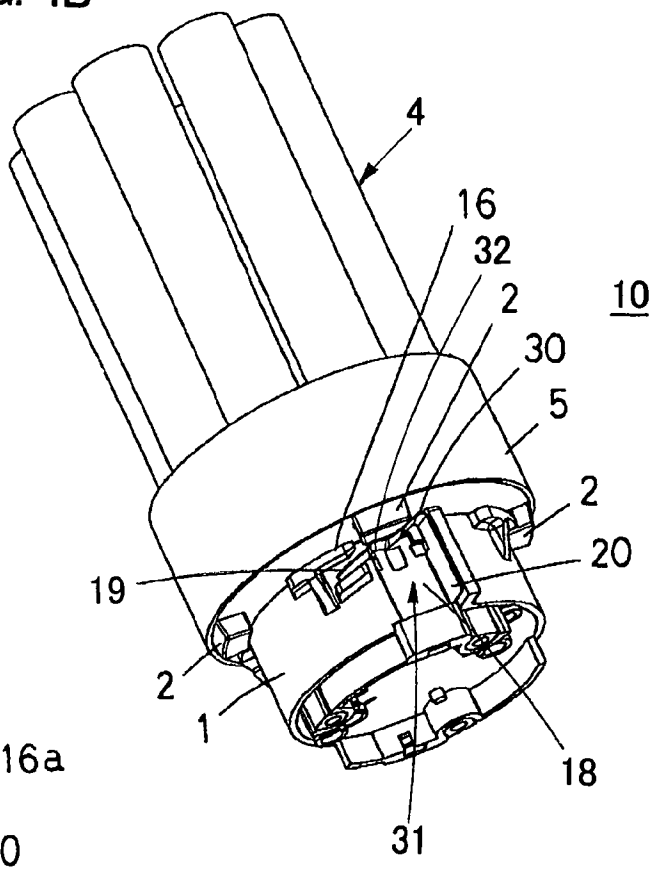
FIG. 4B is a perspective view showing a state that the mounting face of the base of the lamp is contacted with the mounting face of the lamp holder in the first embodiment.
Figure 4A:
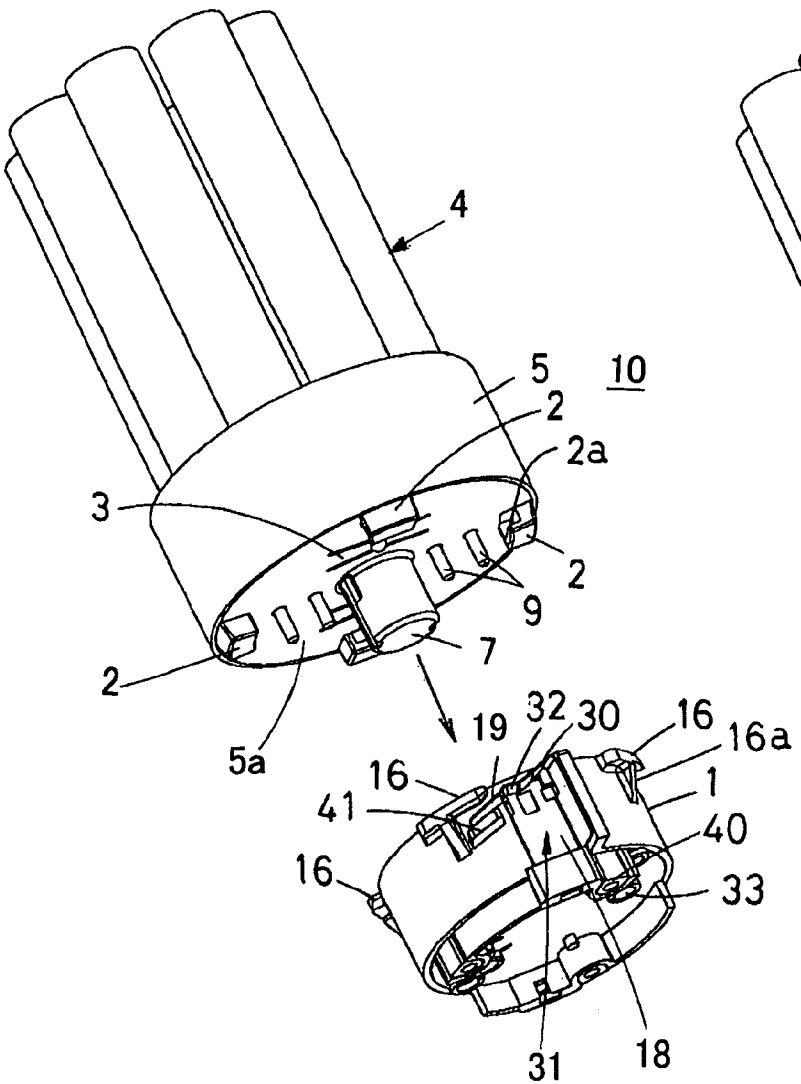
FIG. 4A is a perspective view showing a state before mounting the lamp on the lamp holder in the first embodiment.
Figure 4D:
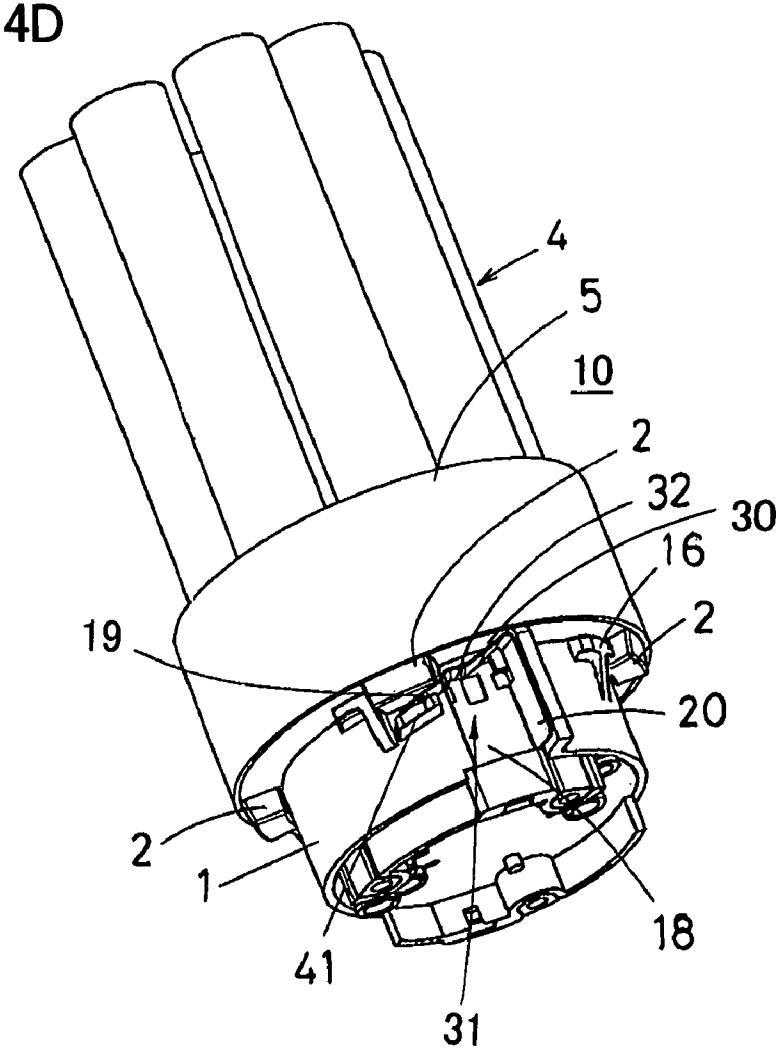
FIG. 4D is a perspective view showing a state that the lamp is completely mounted on the lamp holder in the first embodiment.

Under a condition that the hooking portions 3 are hooked with the hooking receivers 17, that is, the lamp 4 is completely mounted on the lamp holder 1, the lamp holding spring portion 32 of the cantilever spring 19 of the coupler 31 contacts a corner of a rear end of the engaging protrusion 2 in the first turning direction so as to press the engaging protrusion 2 up diagonally, as shown in FIG. 4D. Thus, turning of the base 5 of the lamp 4 due to vibrations in the second turning direction with respect to the lamp holder 1 can be restricted, and backlash between the engaging projection 16 of the lamp holder 1 and the engaging groove 2*a* of the engaging protrusion 2 of the base 5 can be reduced.

Figure 4C:
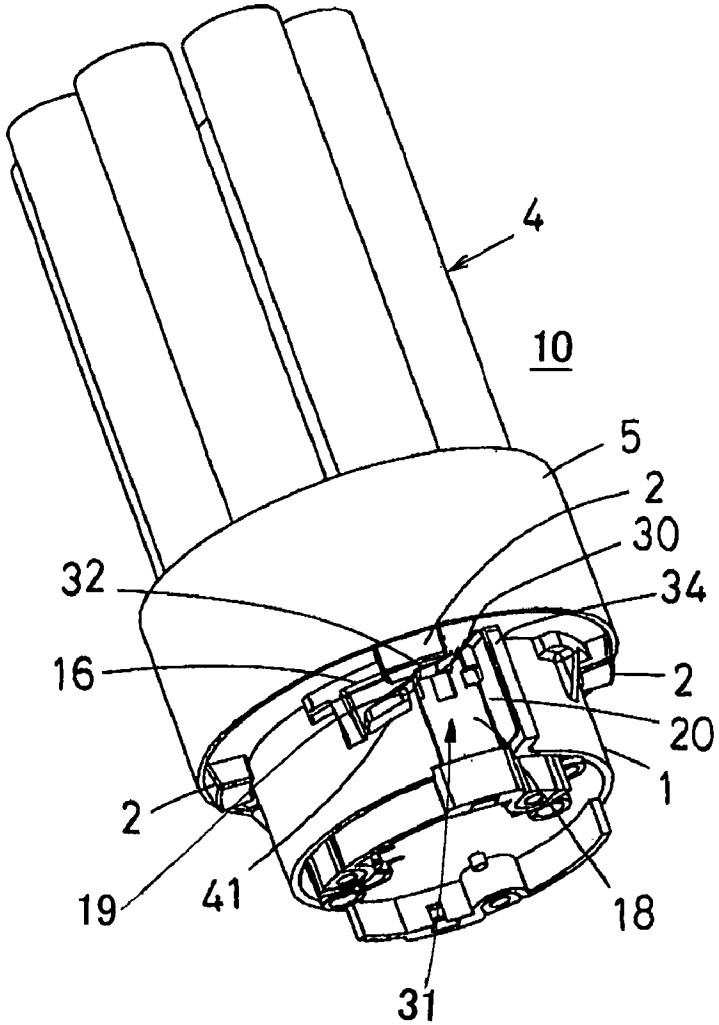
FIG. 4C is a perspective view showing a state that the lamp is turned a little with respect to the lamp holder in the first embodiment.

A temporary lamp holding spring portion 30 is formed on the cantilever spring 19 between the lamp holding spring portion 32 and the standing portion 20 for temporarily holding the base 5 of the lamp 4, while the base 5 of the lamp 4 has been turned with respect to the lamp holder 1. The temporary lamp holding spring portion 30 is slanted toward the lamp holding spring portion 32 from the standing portion 20 in a manner to guide the engaging protrusion 2 of the base 5 in the first turning direction. When the cylindrical protrusion 7 of the base 5 of the lamp 4 is inserted into the circular recess 13, and the base 5 is turned a little with respect to the lamp holder 1, the engaging groove 2*a* of the engaging protrusion 2 is partially engaged with the engaging projection 16. A this time, the temporary lamp holding spring portion 30 contacts the rear end of the engaging protrusion 2 so as to press the engaging protrusion 2 up diagonally, as shown in FIG. 4C. Simultaneously, the protrusion 15 formed on the inner face of the circular recess 13 engages with the second groove 8*b* formed on the outer face of the cylindrical protrusion 7. Consequently, the lamp 4 with the base 5 is temporarily held on the lamp holder 1.

The lamp holding spring portion 32 used for completely holding the base 5 of the lamp 4 and the temporary lamp holding spring portion 30 used for temporarily holding the base 5 of the lamp 5 are serially formed on the same cantilever spring 19 from the standing portion 20. Accordingly, the elastic force P1 (see FIG. 8A) owing to the temporary lamp holding spring portion 30 for pressing the engaging protrusion 2 in the first turning direction is larger than the elastic force P2 (see FIG. 9A) owing to the lamp holding spring portion 32. If the elastic force P1 owing to the temporary lamp holding spring portion 30 is made substantially the same as the elastic force P2 owing to the lamp holding spring portion 32, the force for completely holding the base 5 of the lamp 4 on the lamp holder 1 becomes too large to remove the lamp 4 easily, or the force for temporarily holding the base 5 of the lamp 4 on the lamp holder 1 becomes too small to hold the lamp 4 firmly. Hereupon, a force necessary for dismounting the base 5 of the lamp 4 from the lamp holder 1 must be larger than a sum of the contact friction resistance between the pins 9 and the lamp terminals 28 and the elastic force of the lamp holding spring 32 or the elastic force of the temporary lamp holding spring portion 30.

In addition, the body 11 of the lamp holder 1 further has a plurality of installation holes 40, through which screws for fixing the lamp holder 1 on a ceil or the like, are inserted, and a pair of stoppers 41 for preventing the plastic deformation of the cantilever springs 19.

Subsequently, motion for mounting the lamp 4 on the lamp holder 1 is described with reference to FIGS. 4A to 9B.

Figure 5B:
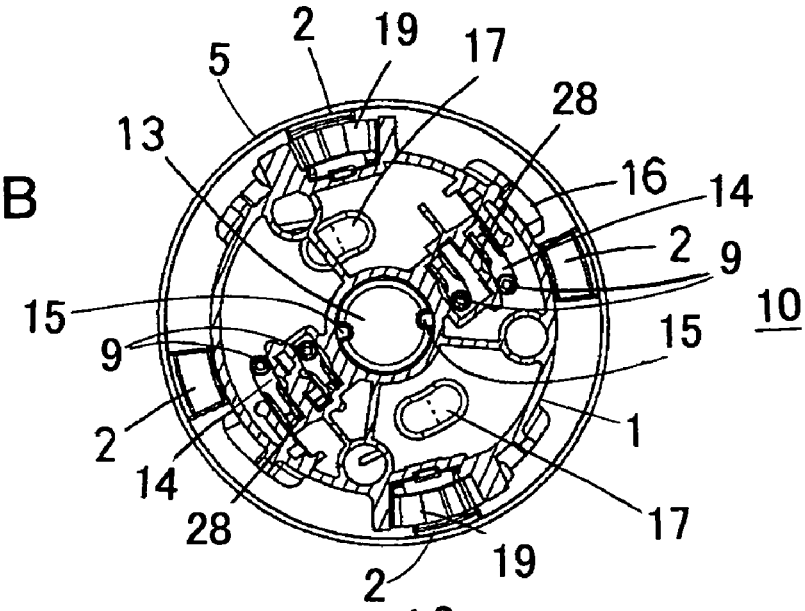
FIG. 5B is a c-c cross sectional view in FIG. 5A.
Figure 5A:
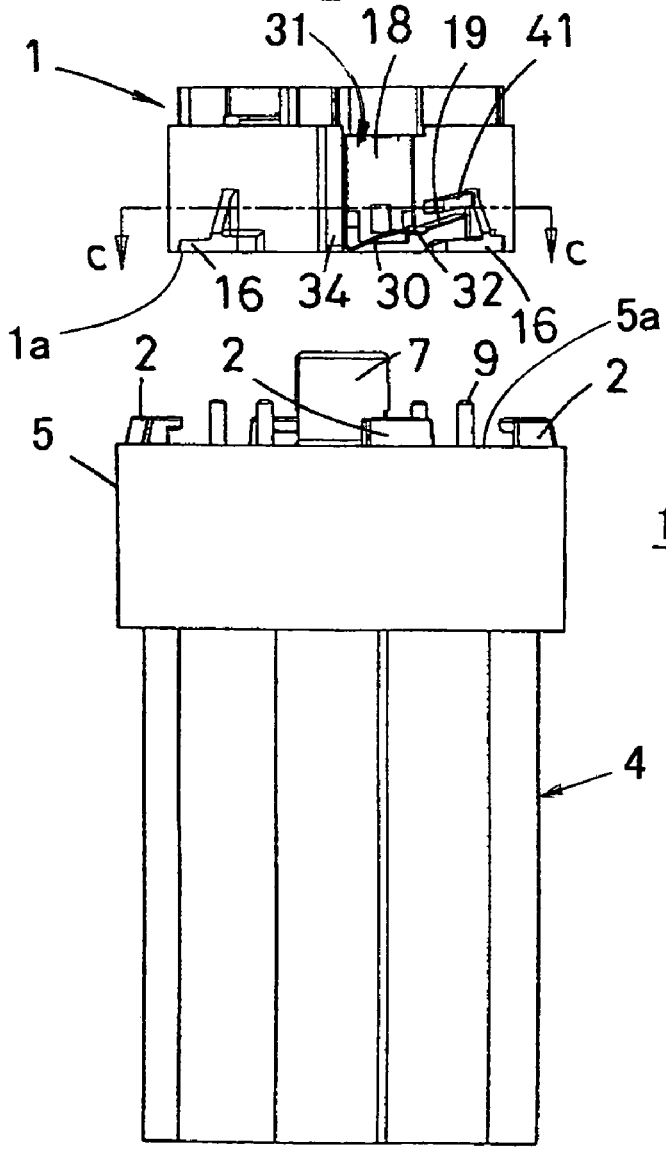
FIG. 5A is a side view showing a state before the lamp is mounted on the lamp holder, corresponding to FIG. 4A.

The lamp 4 will be held with a hand of an operator in a manner so that the second mounting face 5*a* of the base 5 of the lamp 4 faces the first mounting face 1*a* of the lamp holder 1 which is fixed on, for example, a ceil of a structure, as shown in FIGS. 4A and 5A. Hereupon, it is necessary that the wattage of the lamp 4 be coincided with that of the lamp holder 1 so as to be mounted on the lamp holder 1. If the wattage of the lamp 4 is not coincided with that of the lamp holder 1, the cylindrical protrusion 7 of the base 5 of the lamp 4 cannot be inserted into the circular recess 13 of the lamp holder 1.

Figure 6B:
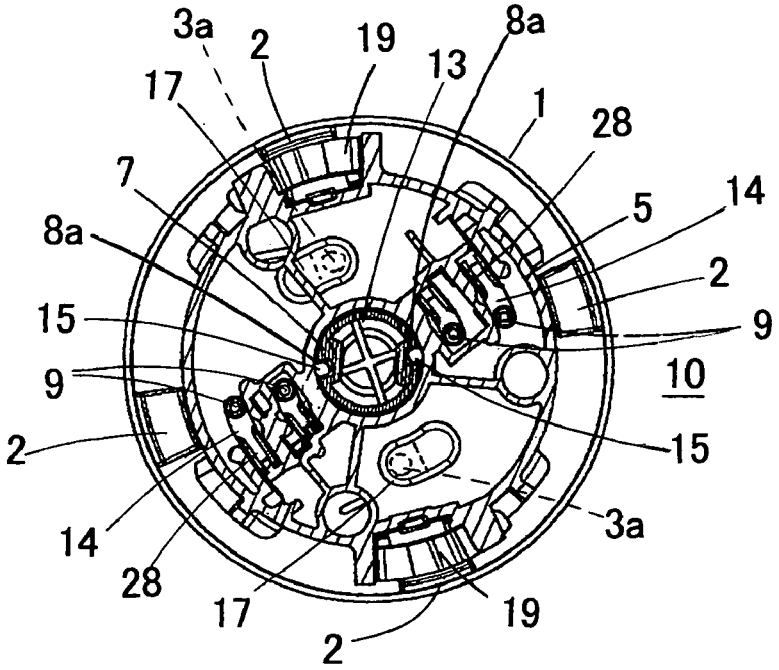
FIG. 6B is a d-d cross sectional view in FIG. 6A.
Figure 6A:
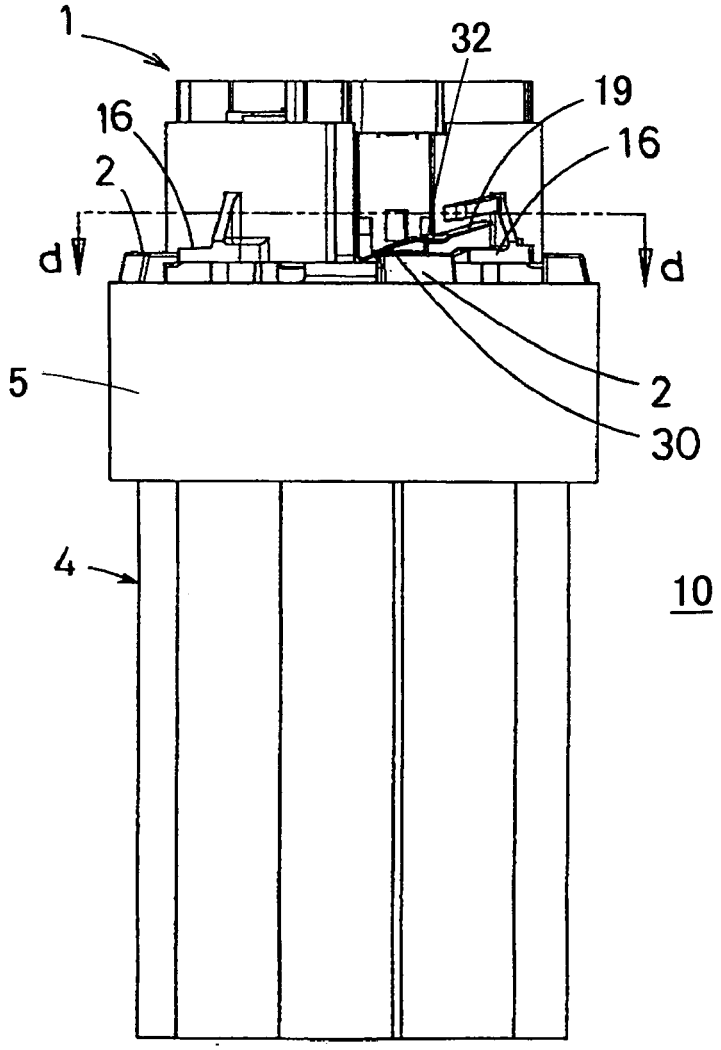
FIG. 6A is a side view showing a state of the middle that the base has been mounted on the lamp holder.

When the wattage of the lamp 4 is coincided with that of the lamp holder 1, the protrusions 15 on the inner face of the circular recess 13 of the lamp holder 1 can be slid in the first grooves 8*a* of the L-shaped grooves 8 on the outer face of the cylindrical protrusion 7, so that the cylindrical protrusion 7 can be inserted into the circular recess 13, as shown in FIGS. 4B, 6A and 6B. Simultaneously, the pins 9 of the lamp 4 are inserted into the jack holes 14 of the lamp holder 1.

The engaging protrusions 2 of the base 5 will contacts the temporary lamp holding spring portions 30 of the cantilever spring 19 at a time a little before the mounting face 5*a* of the base 5 contacts with the mounting face 1*a* of the lamp holder 1, and the temporary lamp holding spring portions 30 of the cantilever spring 19 will be elastically deformed. FIG. 6A shows a state of the middle that the cylindrical protrusion 7 of the base 5 has been inserted into the circular recess 13 of the lamp holder 1. The engaging portions 2 of the base 5 receive elastic reaction forces of the temporary lamp holding spring portions 30 of the cantilever spring 19 in the first turning direction. The protrusion 15 of the lamp holder 1, however, is guided in the first groove 8*a* of the L-shaped groove 8, so that the base 5 cannot be turned with respect to the lamp holder 1.

Figure 7B:
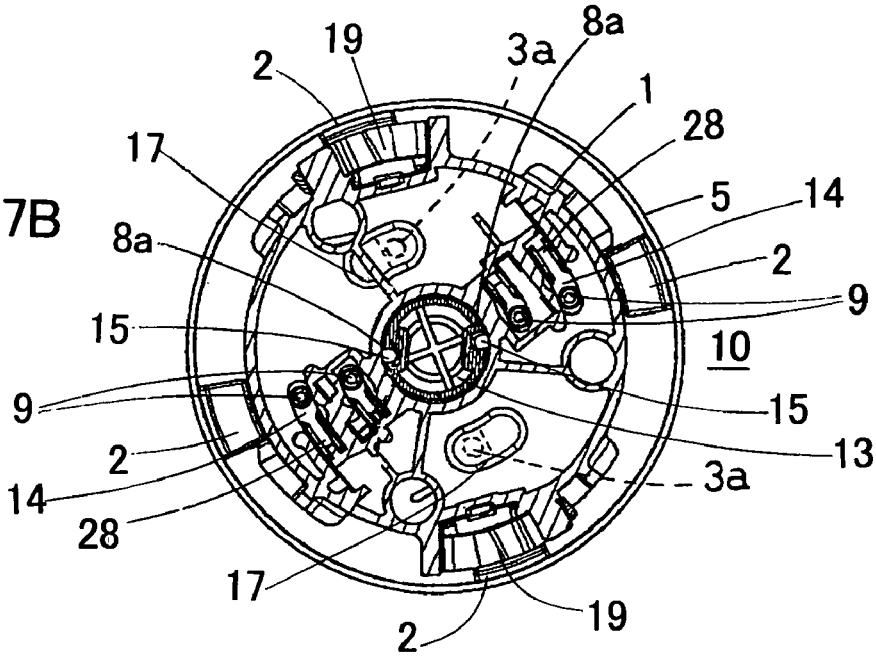
FIG. 7B is an e-e cross sectional view in FIG. 7A.
Figure 7A:
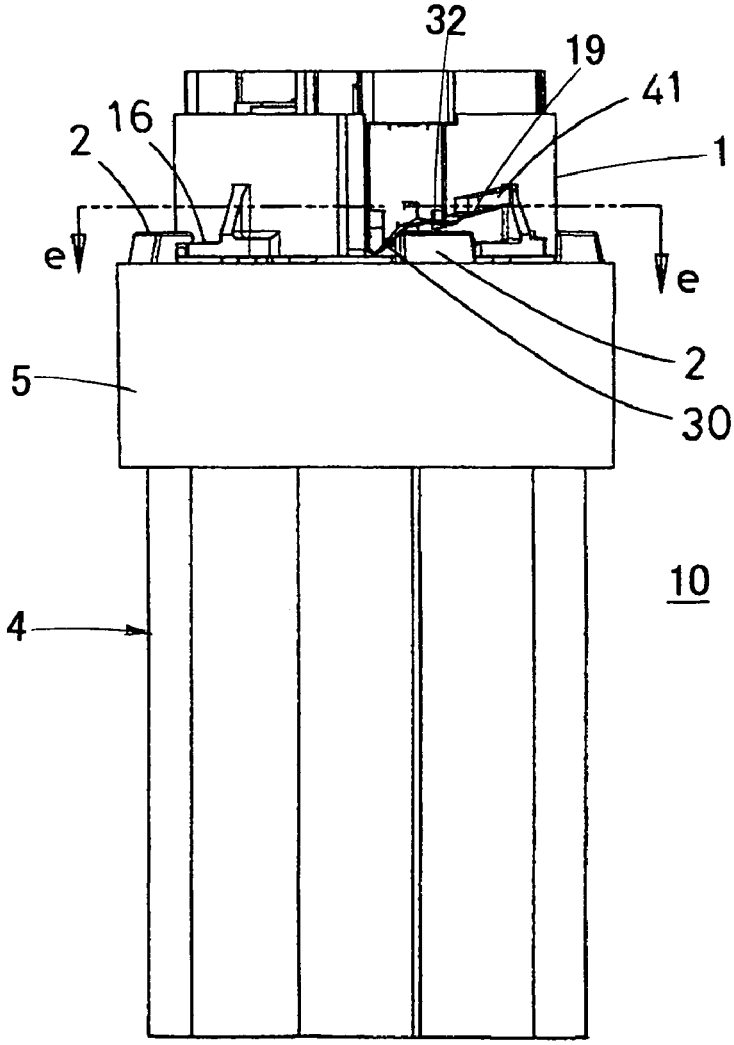
FIG. 7A is a side view showing a state that a mounting face of the lamp contacts a mounting face of the lamp holder, corresponding to FIG. 4B.

FIGS. 4B, 7A and 7B show a state that the second mounting face 5*a* of the base 5 has contacted the first mounting face 1*a* of the lamp holder 1. At this time, the protrusion 15 of the lamp holder 1 is positioned to face the second groove 8*b* of the L-shaped groove 8 of the base 5 of the lamp 4, so that the base 5 of the lamp 4 can be turned a little in the first turning direction with respect to the lamp holder 1 owing to the elastic reaction force of the temporary lamp holding spring portions 30 of the cantilever spring 19.

Figure 8B:
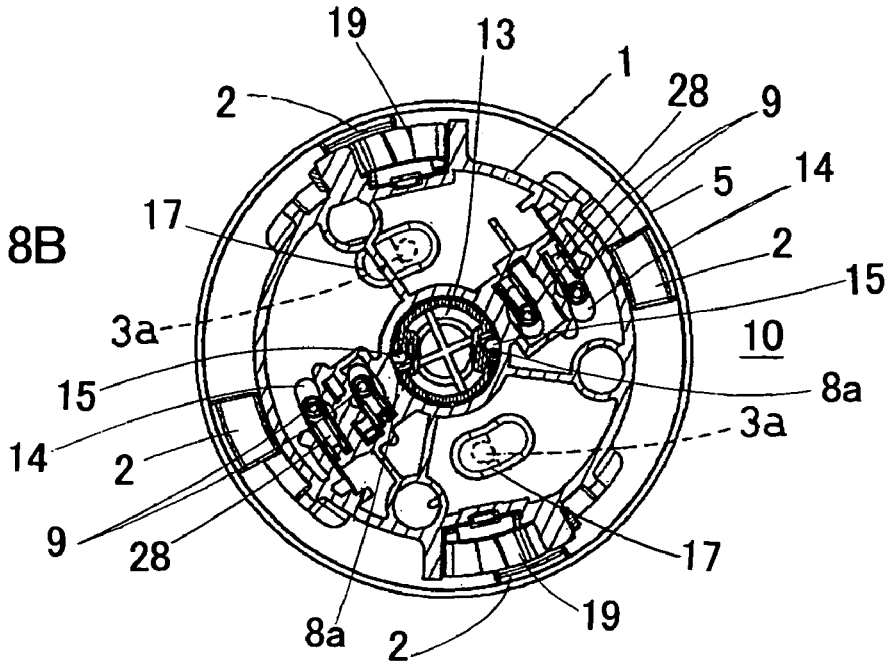
FIG. 8B is an f-f cross sectional view in FIG. 8A.
Figure 8A:
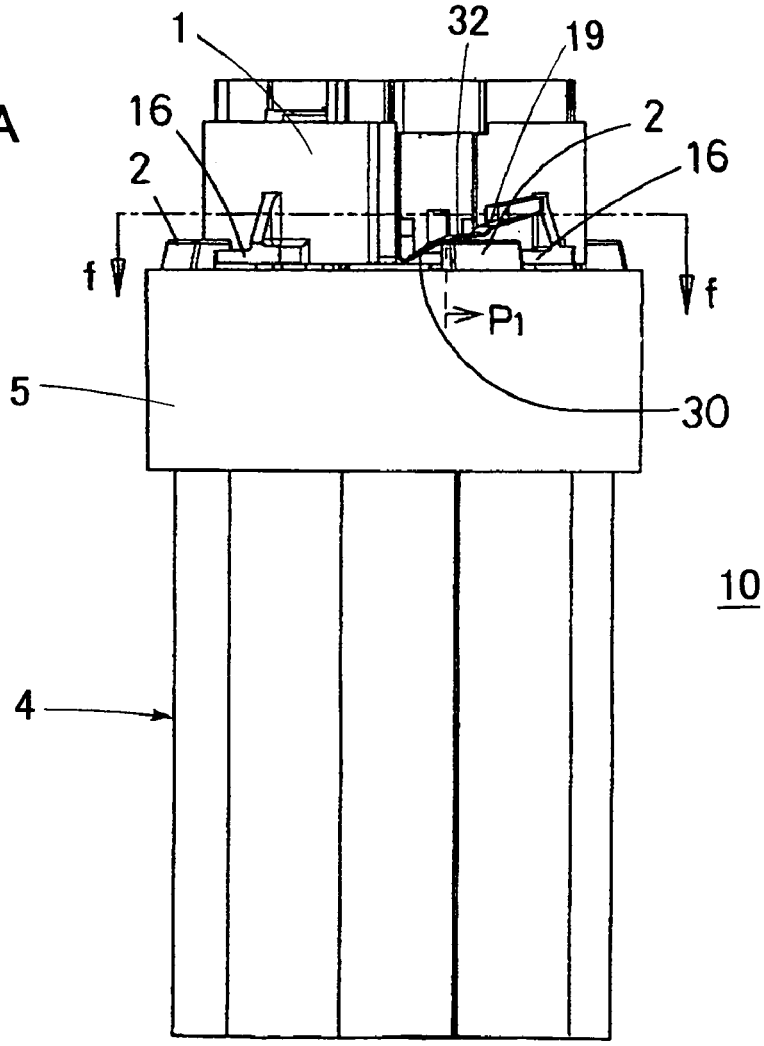
FIG. 8A is a side view showing a state that the lamp is turned a little with respect to and temporarily held on the lamp holder, corresponding to FIG. 4C.

When the base 5 of the lamp 4 is turned, the protrusion 15 of the lamp holder 1 proceeds into and is engaged with the second groove 8*b* of the L-shaped groove 8 of the base 5 of the lamp 4. Furthermore, the engaging projections 16 of the lamp holder 1 proceed into and are partially engaged with the engaging grooves 2*a* of the engaging protrusion 2 of the base 5 of the lamp 4, as shown in FIGS. 4C, 8A and 8B. Thus, the base 5 of the lamp 4 is temporarily held on the lamp holder 1.

Figure 9B:
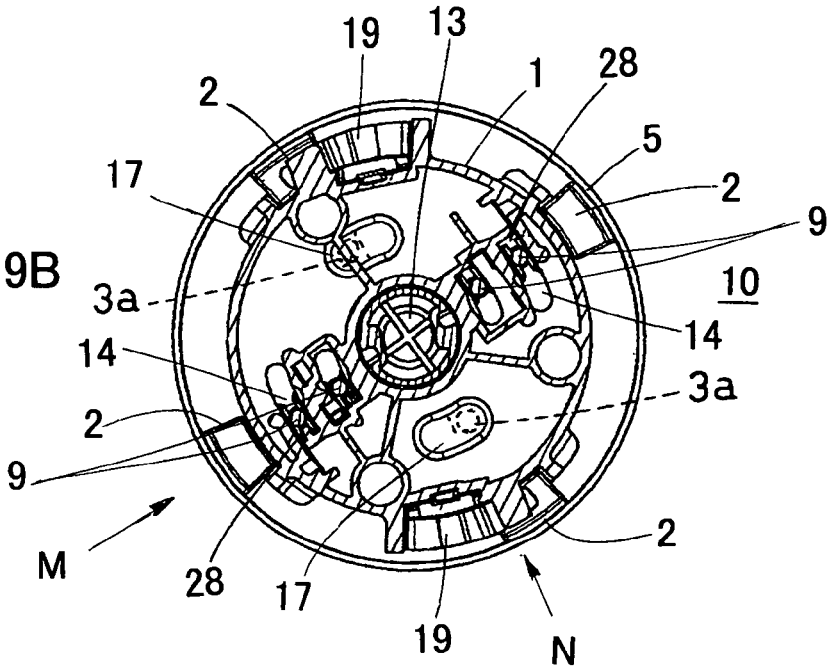
FIG. 9B is a g-g cross sectional view in FIG. 9A.
Figure 9A:
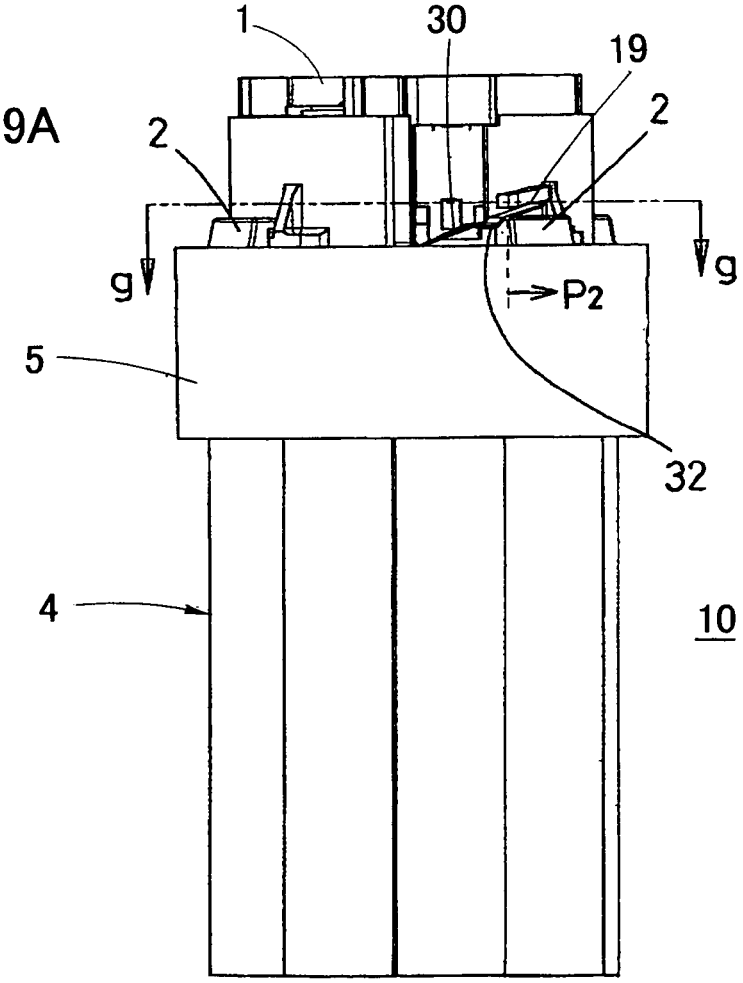
FIG. 9A is a side view showing a state that the mounting face of the base of the lamp is completely mounted on the mounting face of the lamp holder, corresponding to FIG. 4D.

FIGS. 4D, 9A and 9B show a state that the base 5 of the lamp 4 is fully turned in the first turning direction with respect to the lamp holder 1. When the front end of the engaging projection 16 contacts the closed end of the engaging groove 2*a* or the end face of the engaging protrusion 2 contacts the reinforcing rib 16*a*, the turning of the base 5 of the lamp 4 with respect to the lamp holder 1 is stopped. At this time, the pins 9 of the lamp 4 are clipped on the lamp terminals 28, so that the pins 9 are electrically connected to the wires. The hooking protrusions 3*a* of the hooking portion 3 of the base 5 of the lamp 4 have climbed over and are engaged with the protrusions 17*b* in the holes 17*a* of the hooking receivers 17 of the lamp holder 1 owing to elastic deformation of the spring portion 3*c*.

Simultaneously, the engaging protrusions 2 have climbed over the lamp holding spring portions 32 of the cantilever springs 19, so that the rear ends of the engaging protrusions 2 are pressed in the first turning direction by the lamp holding spring portions 32. Consequently, the base 5 of the lamp 4 in the second turning direction with respect to the lamp holder 1 cannot be turned easily, and the backlash between the engaging projection 16 of the lamp holder 1 and the engaging groove 2*a* of the engaging protrusion 2 of the base 5 can be reduced. Even though the lighting apparatus 10 with the lamp 4 and the lamp holder 1 is used in a position where vibrations are applied, the base 5 of the lamp 4 rarely turns with respect to the lamp holder 1 against the elastic forces of the cantilever spring 19. Furthermore, the pins 9 of the lamp 4 are rarely disconnected from the lamp terminals 28, so that the reliability of the electrical connection of the lamp 4 and the lamp holder 1 can be increased.

For dismounting the lamp 4 from the lamp holder 1, the reverse procedure of those described above is executed. When the base 5 of the lamp 4 is started to turn in the second turning direction, the engaging protrusions 2 of the base 5 push the lamp holding spring portions 32 of the cantilever spring 19 so as to be deformed, and will climb over the lamp holding spring portion 32 of the cantilever spring 19. When the engaging protrusions 2 of the base 5 move to positions contacting the temporary lamp holding spring portion 30 of the cantilever spring 19, the pins 9 of the lamp 4 are disconnected from the lamp terminals 28. The hooking protrusions 3*a* of the hooking portion 3 of the base 5 climb over the protrusions 17*b* in the holes 17*a* of the hooking receivers 17 of the lamp holder 1 against the elastic force of the spring portion 3*c*, so that the operator can feel the click. When the base 5 is further turned against the elastic reaction force due to the temporary lamp holding spring portion 30 of the cantilever spring 19, the engaging projections 16 of the lamp holder 16 come out and are disengaged from the engaging grooves 2*a* of the engaging protrusions 2 of the base 5. Simultaneously, the protrusions 15 on the circular recess of the lamp holder 1 moves into the first groove 8*a* from the second groove 8*b* of the L-shaped groove 8 on the cylindrical protrusion 7 of the base 5. Thus, the cylindrical protrusion 7 of the base 5 can be pulled out from the circular recess 13 of the lamp holder 1. Consequently, the lamp 4 can be dismounted from the lamp holder 1.

Figure 10B:
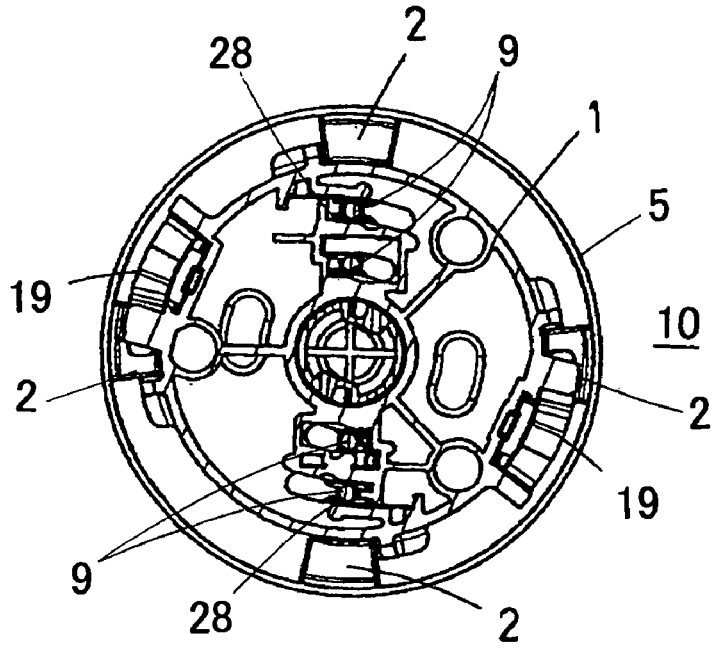
FIG. 10B is an a-a cross sectional view in FIG. 10A.
Figure 10A:
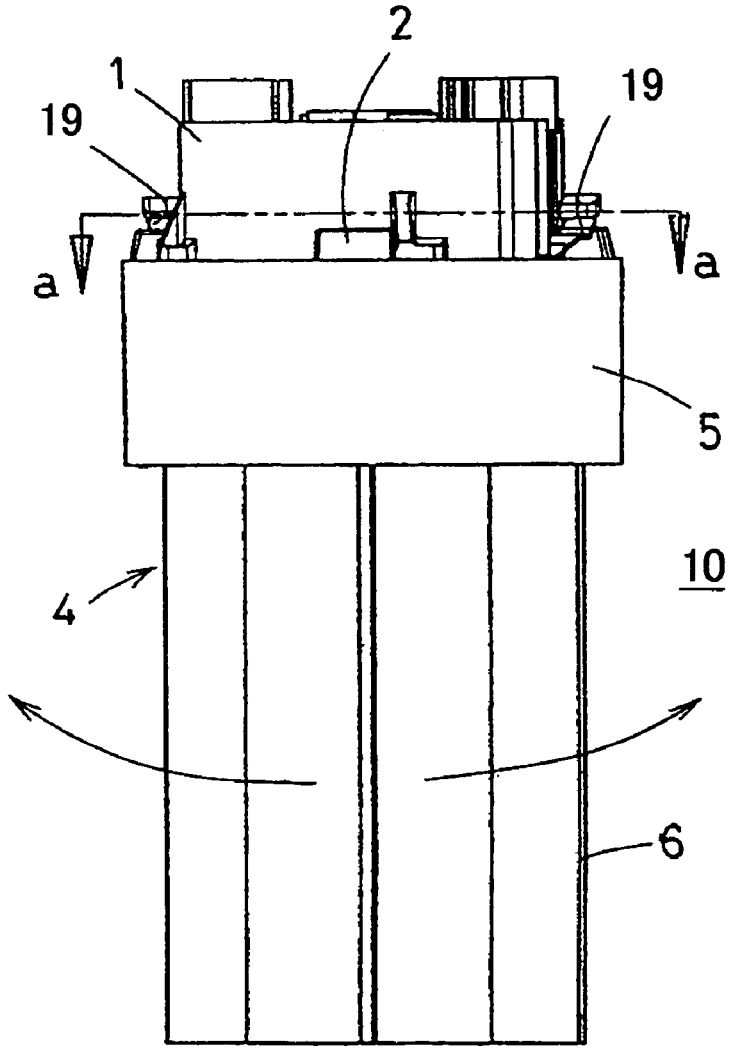
FIG. 10A is a side view showing the lamp holder and the fluorescent lamp in the first embodiment illustrated in different direction shown by arrow M in FIG. 9A.
Figure 11B:
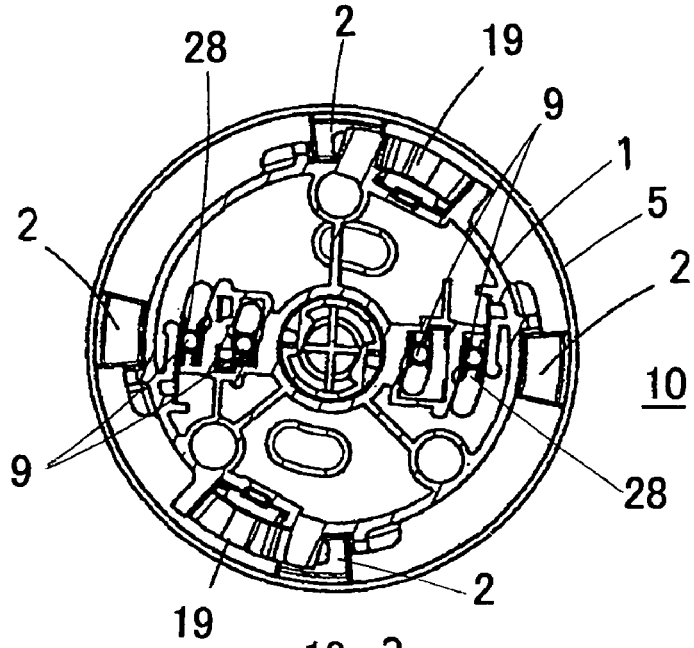
FIG. 11B is a b-b cross sectional view in FIG. 11A.
Figure 11A:
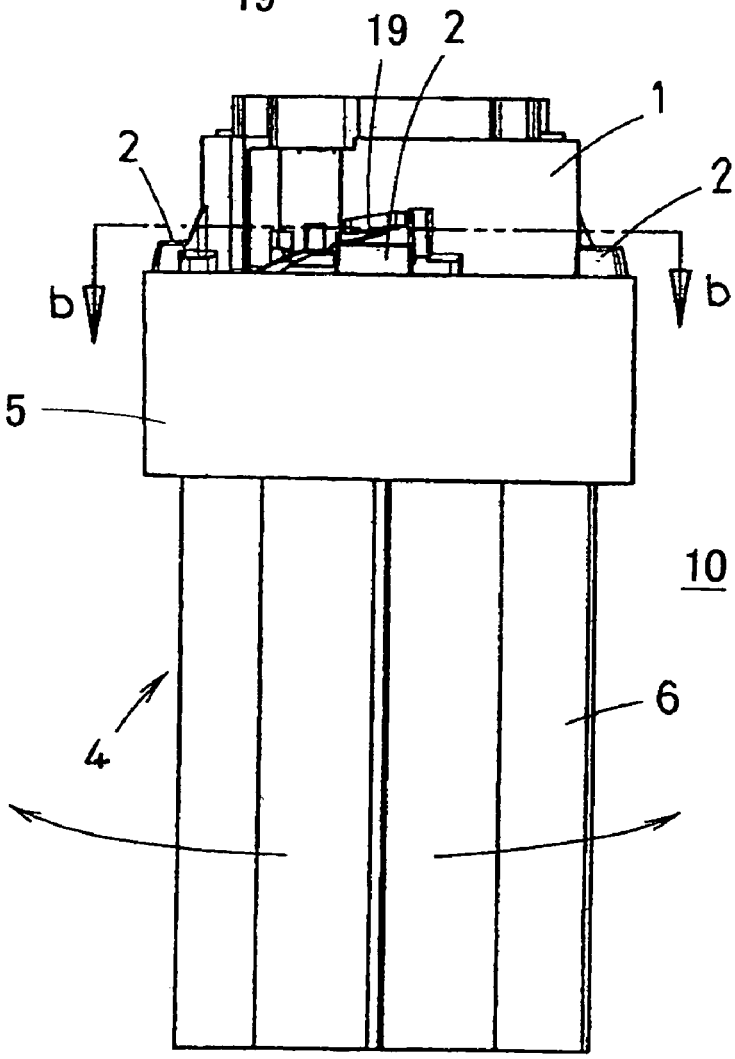
FIG. 11A is a side view of the of the lamp holder and the fluorescent lamp in the first embodiment illustrated in another different direction shown by arrow N in FIG. 9A.

A merit of the lamp holder 1 in the first embodiment is described with reference to FIGS. 10A, 10B, 11A and 11B. FIGS. 10A and 10B show a state that the lamp 4 mounted on the lamp holder 1 illustrated from another direction shown by arrow M in FIG. 9B. FIGS. 11A and 11B further show the state that the lamp 4 mounted on the lamp holder 1 illustrated from still another direction shown by arrow N in FIG. 9B.

As can be seen from the figures, the cantilever springs 19 are positioned on a line crossing at substantially right angle with a line of arrangement of the lamp terminals 28 to which the lamp pins 9 of the lamp 4 are connected. In such a configuration, even if a force is applied to the lamp 4 in one of directions shown by arrows in FIG. 10A, the engaging protrusion 2 of the base 5 is pushed by the cantilever spring 19 at an end of the mounting face, and the engaging projection 16 of the lamp holder 1 serves as a stopper for restricting the movement of the engaging protrusion 2 of the base 5 at the other end of the mounting face. Thus, the movements (backlash) or swing of the lamp 4 in the directions shown by arrows in FIG. 10A can be restricted. Furthermore, the movement or swing of the lamp 4 in the directions shown by arrows illustrated in FIG. 11A is essentially small, since the pins 9 of the lamp 4 are clipped on the lamp terminals 28.

According to the above-mentioned first embodiment, a pair of cantilever springs 19 with the lamp holding spring portions 32 and the temporary lamp holding spring portions 30 are provided for restricting the dismounting of the lamp 4 from the lamp holder 1 in the second turning direction opposite to the first turning direction for mounting the lamp 4 on the lamp holder 1, further to the hooking protrusion 3*a* of the hooking portion 3 of the base 5 of the lamp 4 and the protrusion 17*b* in the hole 17*a* of the hooking receiver 17 of the lamp holder 1. The cantilever springs 19 apply the elastic reaction force owing to deformation thereof to the engaging protrusions 2 of the base 5 in the first turning direction for counteracting the turn of the base 5 in the second turning direction opposite to the first turning direction. Thus, the lamp 4 cannot be dismounted easily from the lamp holder 1 due to vibrations or the like. Furthermore, the temporary lamp holding spring portion 30 is formed on each cantilever spring 19, so that the base 5 of the lamp 4 can be held on the lamp holder 1 temporarily. The falling of the lamp 4 from the lamp holder 1 due to betwixt and between mounting can be prevented while the lamp 4 has been mounted on the lamp holder 1.

Even if the hooking protrusions 3*a* of the hooking portions 3 of the base 5 which are integrally formed with the spring portions 3*c* are broken, the cantilever spring 19 can serve as hooking portions instead of the hooking portions 3, so that it is possible to prevent unexpected falling of the lamp 4 from the lamp holder 1.

Still furthermore, the cantilever springs 19 respectively contact with the engaging protrusions 2 of the base 5 of the lamp 4 for applying elastic force, when the lamp 4 is completely mounted on the lamp holder 1. Thus, the backlash between the base 5 of the lamp 5 and the lamp holder 1 can be reduced, and the vibration or movement between the pins 9 of the lamp 4 and the lamp terminals 28 of the lamp holder 1 can be reduced. Consequently, the reliability of electrical connection of the pins 9 of the lamp 4 and the lamp terminals 28 of the lamp holder 1 can be increased in the use in location with much vibration.

Second Embodiment

A lamp holder for a lamp with a single base and a lighting apparatus using the same in accordance with a second embodiment of the present invention is described with reference to the FIGS. 12A to 17B. In the second embodiment, a temporary lamp holding spring 50 is used instead of a pair of cantilever springs 19 formed on the couplers 31 in the first embodiment.

Figure 12B:
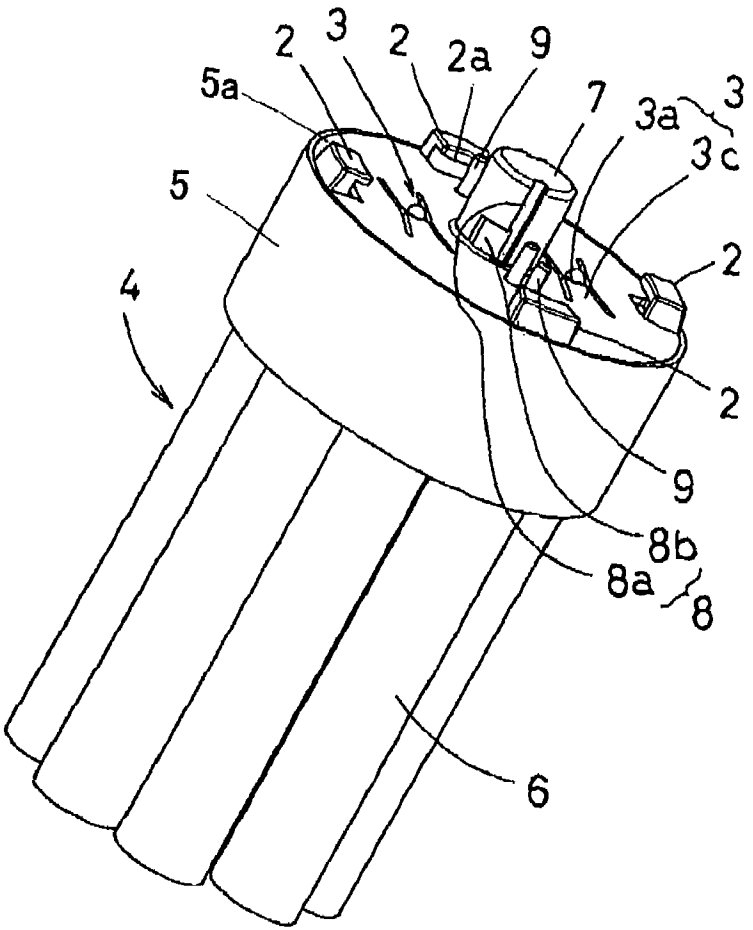
FIG. 12B is a perspective view showing a configuration of a lamp with a single base in the second embodiment.
Figure 12A:
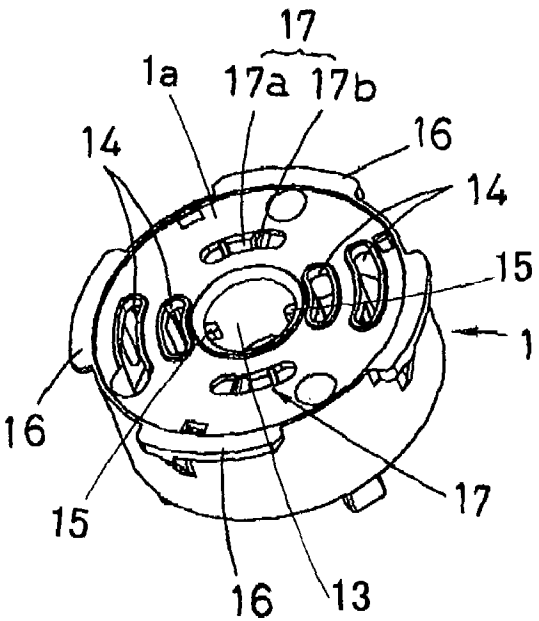
FIG. 12A is a perspective view showing a configuration of a lamp holder in accordance with a second embodiment of the present invention.
Figure 13B:
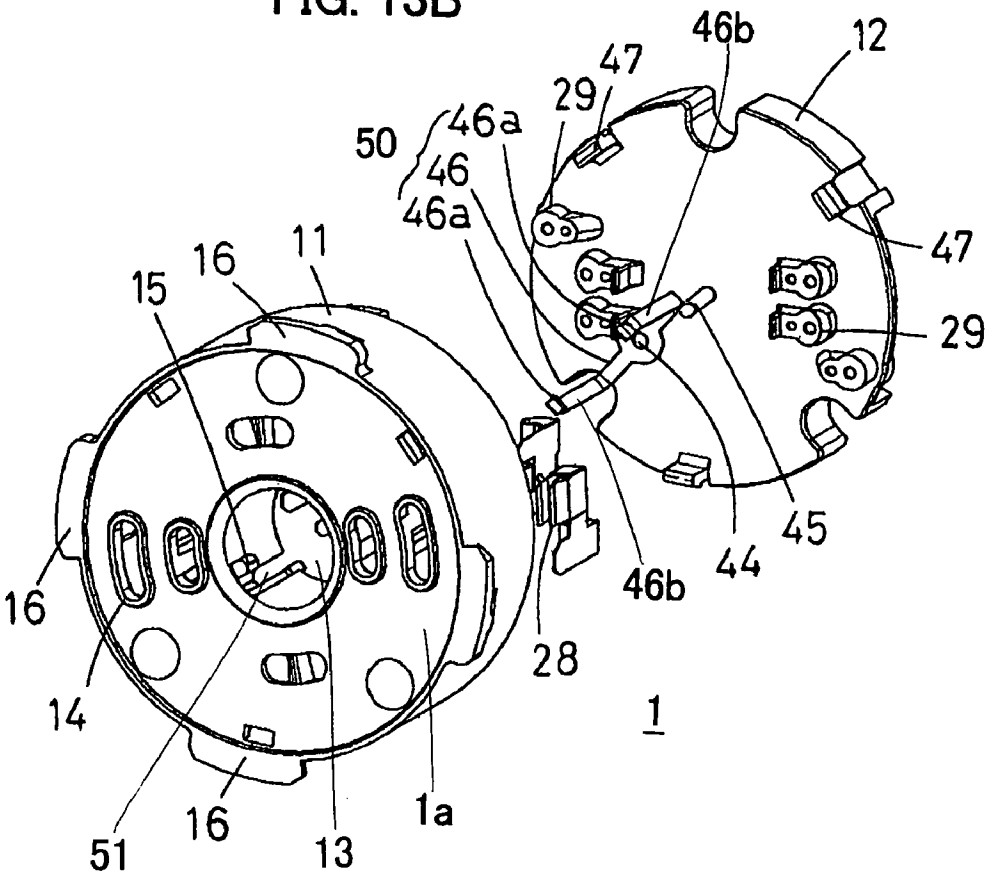
FIG. 13B is an exploded perspective view especially showing an inner configuration of the palm holder in the second embodiment.
Figure 13A:
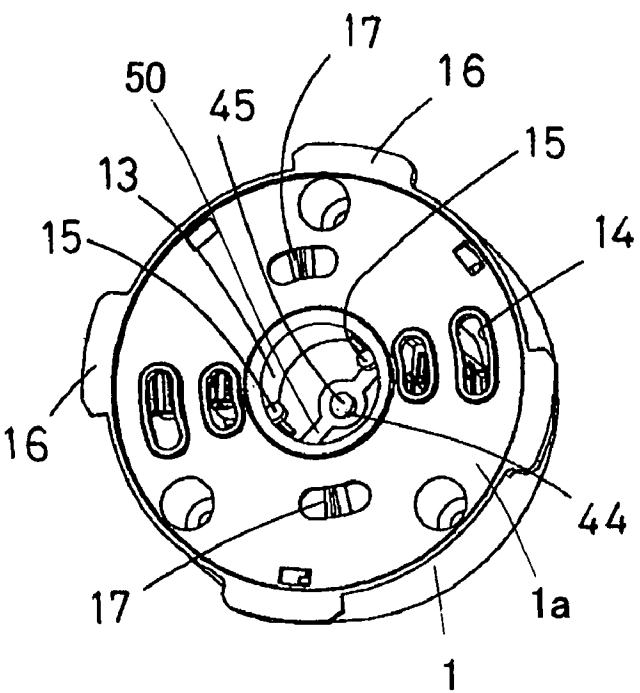
FIG. 13A is a perspective view especially showing a detailed configuration of a mounting face of the lamp holder in the second embodiment.

FIG. 12A shows a configuration of the lamp holder 1, and FIG. 12B shows a configuration of the lamp 4 with the base 5, in the second embodiment. FIG. 13A shows the configuration of the lamp holder 1 illustrated from another direction. FIG. 13B shows an inner configuration of the lamp holder 1 in the second embodiment.

As can be seen from FIG. 13B, the lamp holding spring 50 has a pair of arms 46*b* protruded forward from both sides of a bar 46, and a hole 44 formed at the center of the bar 46. A boss 45 is formed at the center on an inner face of the cover 12, with which the hole 44 of the lamp holding spring 50 is engaged. A head of the boss 45 is deformed due to cold caulking, so that the lamp holding spring 50 is held on the cover 12. A pair of slits 51 is formed on the inner face of the circular recess 13 at positions adjoining the protrusions 15, into which the arms 46*b* are fitted. A stepped hooking portion 46*a* is formed in the vicinity of front end of each arm 46*b* in a manner to protrude inwardly. When the arms 46*b* are fitted into the slits 51, the hooking portions 46*a* are protruded outward from the inner face of the circular recess 13 at positions adjoining the protrusions 15.

The lamp holder 1 in the second embodiment has no coupler 31, which is used in the first embodiment. Thus, a plurality of hooking protrusions 47 is formed at periphery portions on the inner face of the cover 12, and a plurality of hooking recesses (not shown) is formed on an inner face of the body 11 at positions corresponding to the hooking protrusions 47 when the opening of the body 11 is sealed with the cover 12.

While the cylindrical protrusion 7 of the base 5 of the lamp 4 has been inserted into the circular recess 13 of the lamp holder 1, the front end of the cylindrical protrusion 7 contacts the hooking portions 46*a* of the lamp holding spring 50, and the stepped portions 64*a* are elastically deformed to withdraw to mural inside of the circular recess 13. When the cylindrical protrusion 7 of the base 5 is completely inserted into the circular recess 13, the hooking portions 46*a* of the lamp holding spring 50 are respectively positioned to face the second grooves 8*b* of the L-shaped grooves 8 formed on the outer face of the cylindrical protrusion 7. When the base 5 is further turned in the first turning direction with respect to the lamp holder 1, the hooking portions 46*a* of the lamp holding spring 50 proceed into the second grooves 8*b* following to the protrusions 15, and protrude from the mural of the circular recess 13. Thus, the hooking portions 46*a* of the lamp holding spring 50 are engaged with the second grooves 8*b* of the L-shaped grooves 8. The second groove 8*b* in the second embodiment is formed longer in circumferential direction than that in the first embodiment.

Figure 14A:
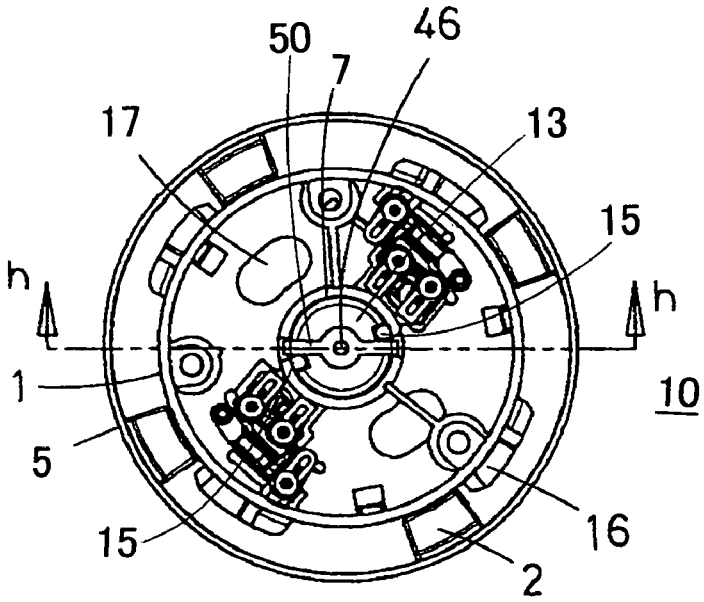
FIG. 14A is a rear view showing a state before the lamp is mounted on the lamp holder in the second embodiment.
Figure 14B:
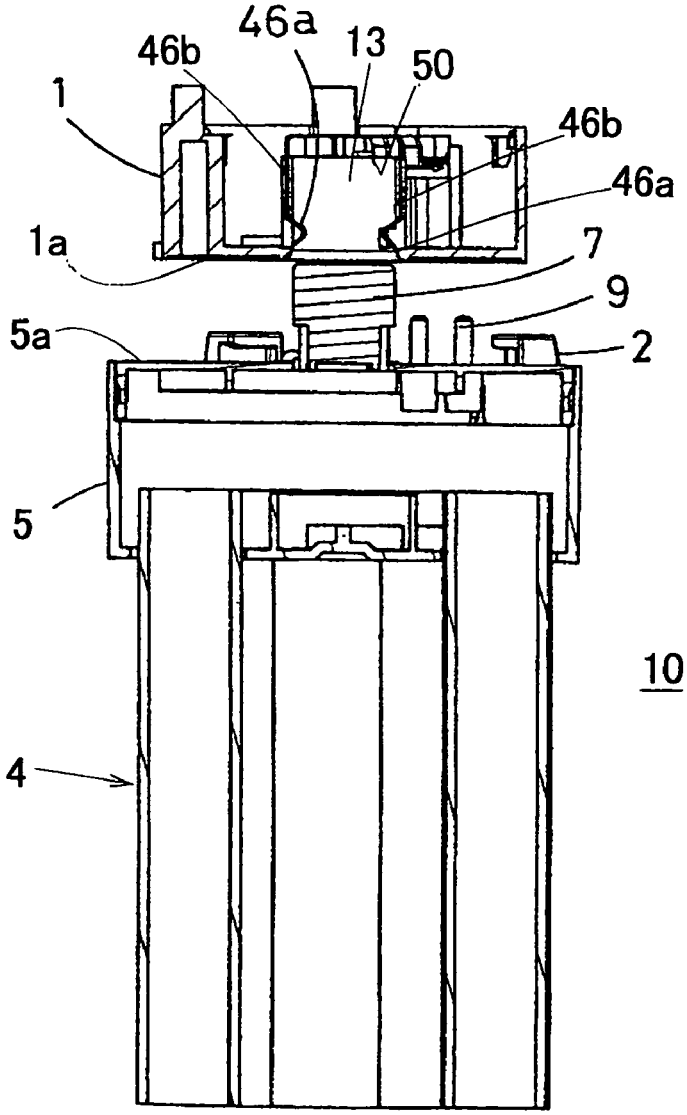
FIG. 14B is an h-h cross sectional view in FIG. 14A.
Figure 15A:
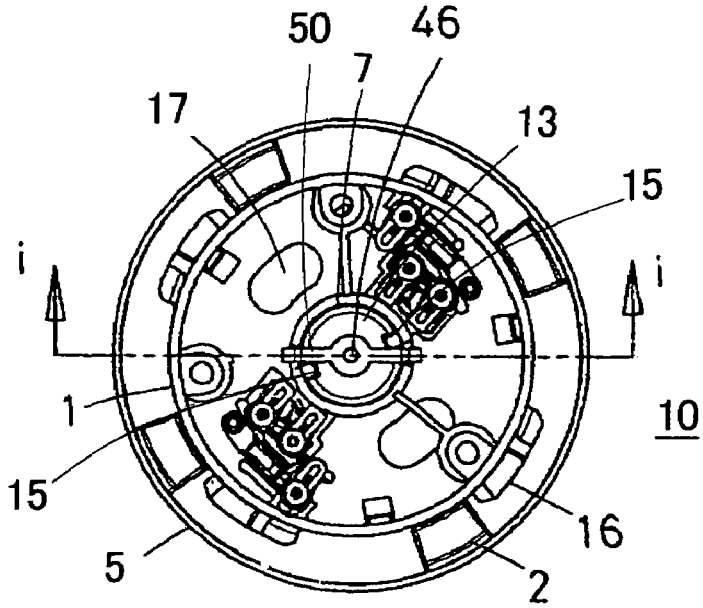
FIG. 15A is a rear view showing a state of the middle that the base has been mounted on the lamp holder in the second embodiment.
Figure 15B:
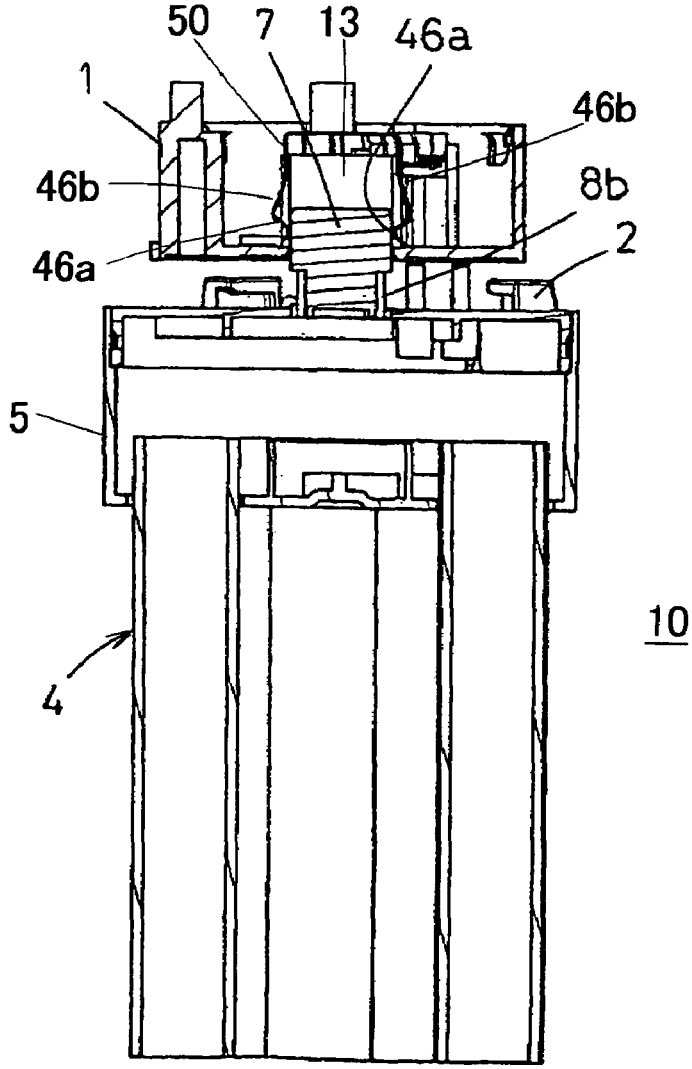
FIG. 15B is an i-i cross sectional view in FIG. 15A.

FIGS. 14A and 14B show a state before mounting the base 5 of the lamp 4 on the lamp holder 1. FIGS. 15A and 15B show a state of the middle while the cylindrical protrusion 7 of the base 5 of the lamp 4 has been inserted into the circular recess 13 of the lamp holder 1. At this time, when the wattage of the lamp 4 is coincided with the wattage of the lamp holder 1, that is, the positions, the widths, and so on of the protrusions 15 and the L-shaped grooves 8 are corresponded, the cylindrical protrusion 7 can be inserted into the circular recess 13.

Figure 16A:
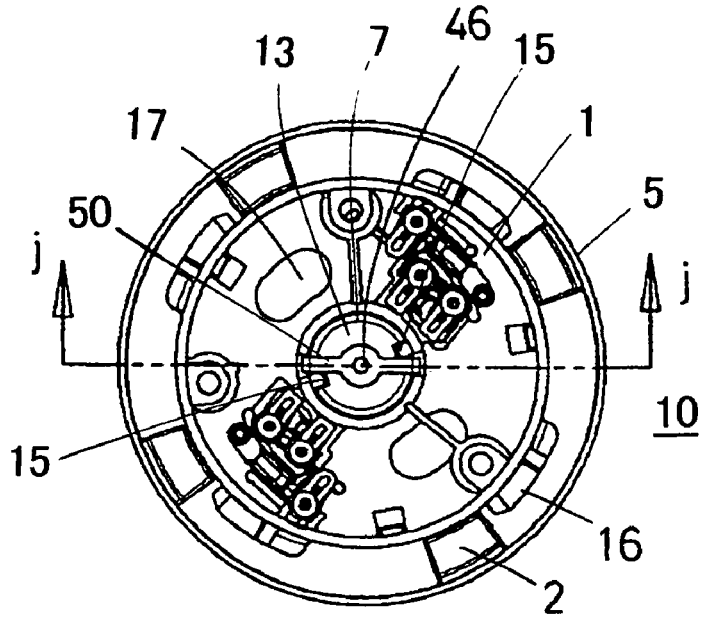
FIG. 16A is a rear view showing a state that a mounting face of the lamp contacts a mounting face of the lamp holder in the second embodiment.
Figure 16B:
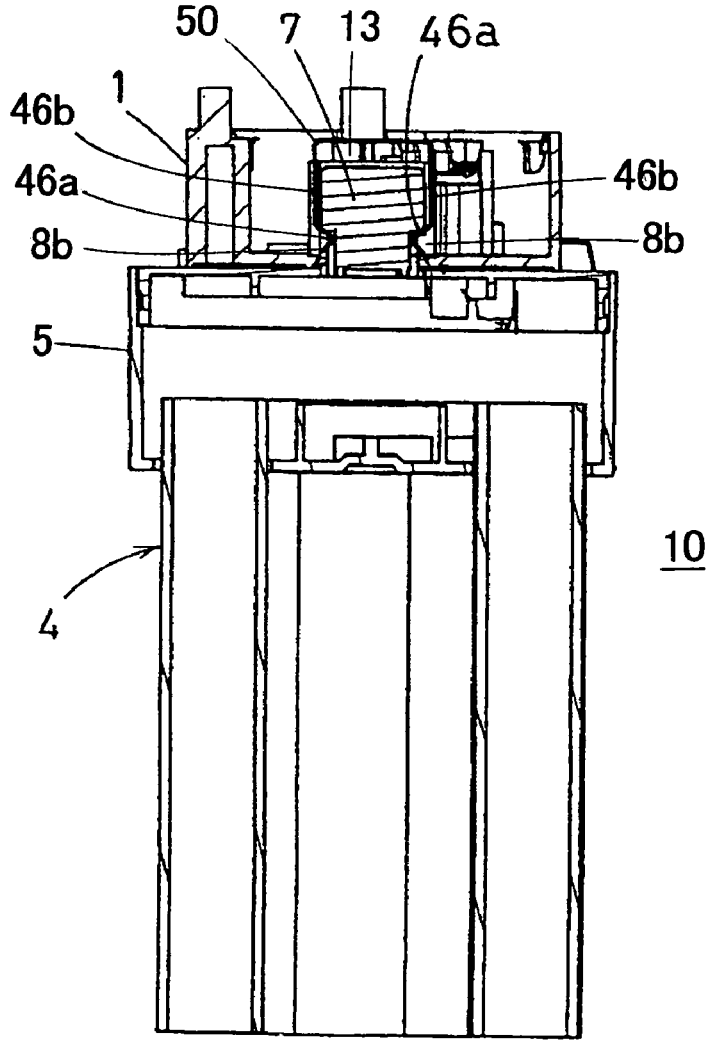
FIG. 16B is a j-j cross sectional view in FIG. 16A.

FIGS. 16A and 16B show a state that the insertion of the cylindrical protrusion 7 into the circular recess 13 has been completed. At this time, the pins 9 of the lamp 4 are inserted into the jack holes 14 of the lamp holder 1, and the hooking portions 46*a* of the lamp holding spring 50 are engaged with the second grooves 8*b* of the groove 8. Thus, the base 5 of the lamp 4 is temporarily held on the lamp holder 1 owing to the lamp holding spring 50.

Figure 17A:
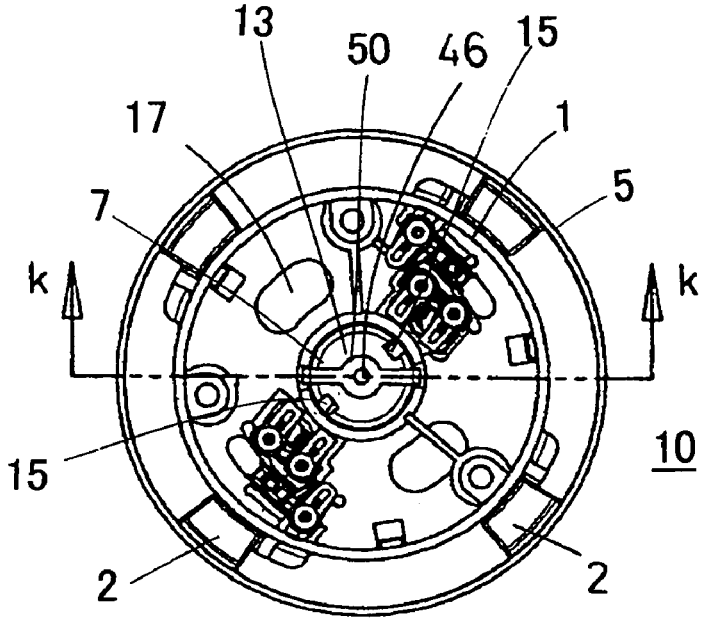
FIG. 17A is a rear view showing a state that the mounting face of the base of the lamp is completely mounted on the mounting face of the lamp holder in the second embodiment.
Figure 17B:
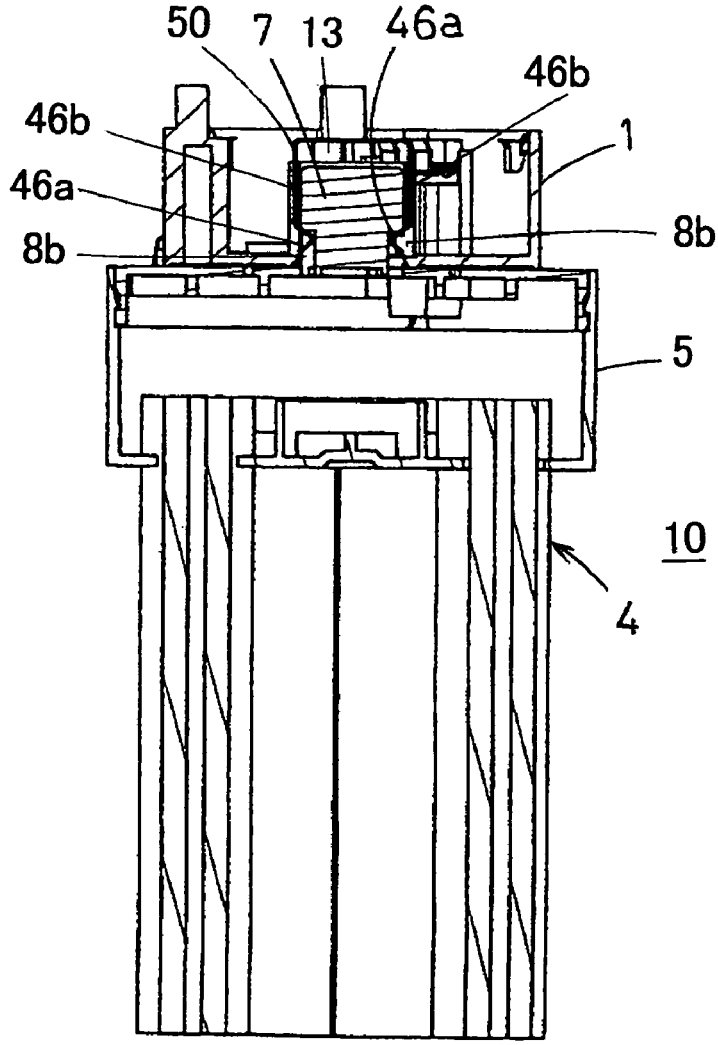
FIG. 17B is a k-k cross sectional view in FIG. 17A.
Figure 18A:
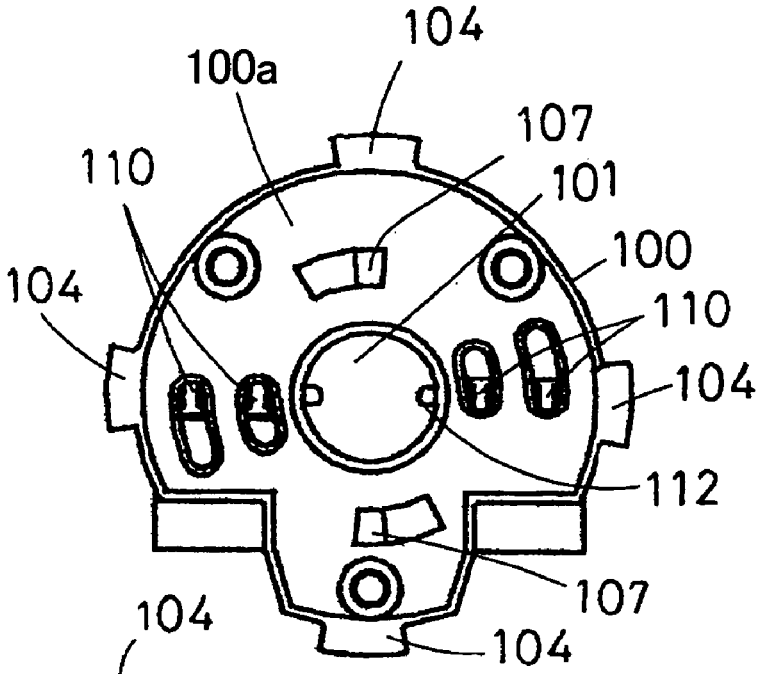
FIG. 18A (PRIOR ART)
FIG. 18A is a front view of a conventional lamp holder for a lamp with a single base.
Figure 18B:
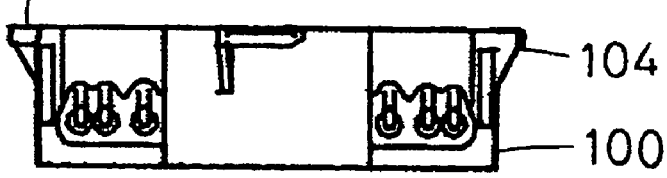
FIG. 18B (PRIOR ART)
FIG. 18B is a side view of the conventional lamp holder shown in FIG. 18A.
Figures 19A, 19B:
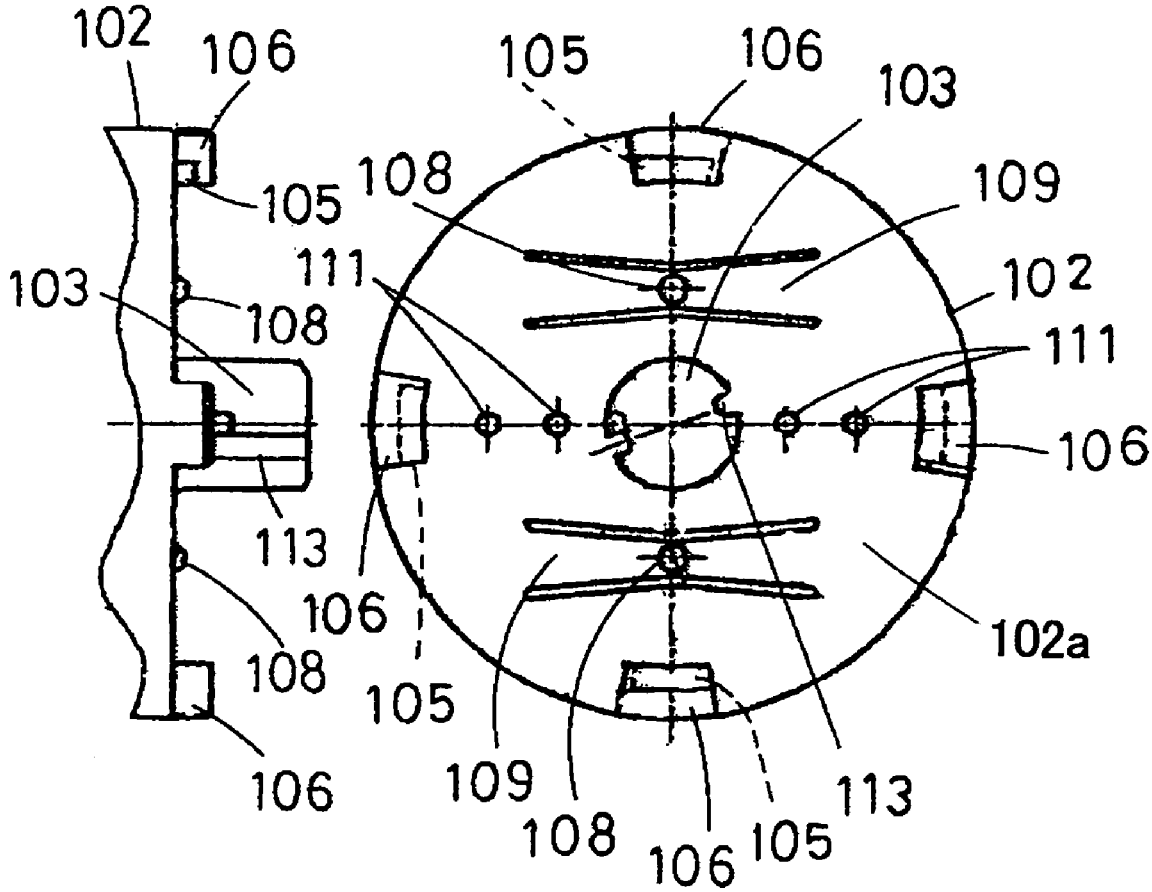
FIG. 19B (PRIOR ART)
FIG. 19A (PRIOR ART)
FIG. 19A is a bottom front view of a conventional base of a lamp with a single base.
FIG. 19B is a partial side view of the conventional base of the lamp shown in FIG. 19A.

FIGS. 17A and 17B show a state that the base 5 of the lamp 4 is turned with respect to the lamp holder 1 and the engaging projections 16 of the lamp holder 1 are engaged with the engaging grooves 2*a* of the engaging protrusions 2 of the base 5. At this time, the pins 9 of the lamp 4 are clipped on the lamp terminals 28 on the lamp holder 1, and the hooking portions 3 on the base 5 are hooked on the hooking receivers 17. The hooking portions 46*a* of the lamp holding spring 50 are still engaged with the second grooves 8*b* of the L-shaped grooves 8 of the base 5. Thus, the base 5 of the lamp 4 has friction resistance, when the base 5 of the lamp 4 is tried to turn in the second direction.

For dismounting the lamp 4 from the lamp holder 1, the reverse procedure of those described above is executed.

In the above-mentioned embodiments, the L-shaped grooves 8 are formed on the outer face of the cylindrical protrusion 7 of the lamp 4 and the protrusions 15 are formed on the inner face of the circular recess 13 of the lamp holder 1. It, however, is possible that the L-shaped grooves 8 are formed on the inner face of the circular recess 13 of the lamp holder 1 and the protrusions 15 are formed on the outer face of the cylindrical protrusion 7.

Furthermore, in the above-mentioned embodiments, the engaging protrusions 2 with engaging grooves 2*a* are formed on the base 5 of the lamp 4 and the engaging projections 16 to be engaged with the engaging grooves 2*a* are formed on the lamp holder 1. It, however, is possible that the engaging protrusions 2 with engaging grooves 2*a* are formed on the lamp holder 1 and the engaging projections 16 to be engaged with the engaging grooves 2*a* are formed on the base 5 of the lamp 4.

Still furthermore, in the above-mentioned embodiments, the hooking portions 3 having the hooking protrusions 3*a* and the spring portion 3*c* are formed on the base 5 of the lamp 4 and the hooking receivers 17 having the protrusion 17*b* formed at substantially the center of the hole 17*a* are formed on the lamp holder 1. It, however, is possible that the hooking portions 3 having the hooking protrusions 3*a* and the spring portion 3*c* are formed on the lamp holder 1 and the hooking receivers 17 having the protrusion 17*b* formed at substantially the center of the hole 17*a* are formed on the base 5 of the lamp 4.

Still furthermore, the coupling of the base 11 and the cover 12 of the lamp holder 1 is not limited the configurations such as using the base plate 18 of the coupler 31 or the hooking protrusions 47 described in the above-mentioned embodiments. Another configuration can be used for coupling the body 11 and the cover 12 of the lamp holder 1.

This application is based on Japanese patent applications 2004-121803 and 2004-121804, which are filed Apr. 16, 2004 in Japan, the contents of which are hereby incorporated by references.

Although the present invention has been fully described by way of example with reference to the accompanying drawings, it is to be understood that various changes and modifications will be apparent to those skilled in the art.

Therefore, unless otherwise such changes and modifications depart from the scope of the present invention, they should be construed as being included therein.

What is claimed is:

1. A lamp holder for a lamp with a single base, on which the base of the lamp is mounted by processes of contacting a second mounting face of the base with a first mounting face of the lamp holder and turning the base in a first turning direction with respect to the lamp holder, comprising:

a plurality of first engaging portions with which a plurality of second engaging portions of the base is engaged so as not to be dismounted in a direction perpendicular to the first and second mounting faces, when the base is turned in the first turning direction;

at least a first hooking portion with which at least a second hooking portion of the base is detachably hooked when the base is turned at a predetermined angle in the first turning direction; and a cantilever spring having at least a lamp holding spring provided as a stepped portion in generally a center of the cantilever spring, wherein the lamp holding spring is configured to apply a force for restricting turning of the base in a second turning direction opposite to the first turning direction under a condition that the second hooking portion of the base is hooked with the first hooking portion.

2. The lamp holder in accordance with claim 1 further comprising a first cylindrical face, which faces a second cylindrical face of the base; and wherein at least a substantially L-shaped groove configured by a first groove formed in a direction perpendicular to the mounting face and a second groove formed in circumferential direction of a cylindrical face is formed on one of the first and second cylindrical face;

at least a protrusion which is to be engaged with the L-shaped groove is formed on the other of the first and second cylindrical face; and the lamp holding spring contacts the second engaging portion of the base for applying the force for restricting turning of the base in a second turning direction.

3. The lamp holder in accordance with claim 1 further comprising at least a temporary lamp holding spring for temporarily holding the base of the lamp when the first mounting face of the lamp holder and the second mounting face of the base are contacted; and wherein;

the lamp holding spring and the temporary lamp holding spring are integrally formed on the same cantilever spring.

4. The lamp holder in accordance with claim 3, wherein the cantilever spring is held at an end of the temporary lamp holding spring on a base plate.

5. The lamp holder in accordance with claim 3, wherein the temporary lamp holding spring applies a force to the second engaging portion of the base for turning the base with respect to the lamp holder In the first turning direction so that the second engaging portion of the base is partially engaged with the first engaging portion of the lamp holder, when the first mounting face of the lamp holder and the second mounting face of the base are contacted.

6. The lamp holder in accordance with claim 3 further comprising a first cylindrical face, which faces a second cylindrical face of the base; and wherein at least a substantially L-shaped groove configured by a first groove formed in a direction perpendicular to the mounting face and a second groove formed in circumferential direction of a cylindrical face is formed on one of the first and second cylindrical face;

at least a protrusion which is to be engaged with the L-shaped groove is formed on the other of the first and second cylindrical face; and when the protrusion reaches to a position facing the second groove of the L-shaped groove, the temporary lamp holding spring applies a force to the second engaging portion of the base for turning the base with respect to the lamp holder in the first turning direction so that the protrusion proceeds into the second groove for temporarily holding the lamp on the lamp holder.

7. The lamp holder in accordance with claim 6, wherein the pushing force of the temporary lamp holding spring applied to the second engaging portion of the base is larger than that of the lamp holding spring.

8. The lamp holder in accordance with claim 1, wherein the base of the lamp has a plurality of pins disposed on a line and symmetrical to a center axis of the turning of the base with respect to the lamp holder;

the lamp holder has a plurality of lamp terminals disposed on a line to which the pins are electrically connected when the base is turned in the first turning direction at a predetermined angle with respect to the lamp holder; and a pair of the lamp holding springs is disposed on a line crossing at substantially right angle with the line on which the lamp terminals are disposed.

9. The lamp holder in accordance with claim 5 further comprising a body and a cover for sealing an opening of the body; and wherein the temporary lamp holding spring and the lamp holding spring are integrally formed with a coupler for coupling the body and the cover.

10. A lighting apparatus configured by at least a lamp holder and a lamp with a single base mounted on the lamp holder, wherein the lamp holder comprising a first mounting face, a plurality of first engaging portions, at least a first hooking portion, and a cantilever spring including at least a lamp holding spring provided as a stepped portion in generally a center of the cantilever spring;

the base of the lamp comprising a second mounting face, a plurality of second engaging portions engaged with the first engaging portions of the lamp holder when the base is turned in a first turning direction, and at least a second hooking portion detachably hooked with the first hooking portion of the lamp holder so as not to be dismounted in a direction perpendicular to the first and second mounting faces when base is turned at a predetermined angle in the first turning direction; and the lamp holding spring applies a force for restricting turning of the base in a second turning direction opposite to the first turning direction under a condition that the second hooking portion of the base is hooked with the first hooking portion.

11. The lighting apparatus in accordance with claim 10, wherein the lamp holder further comprises a first cylindrical face, which faces a second cylindrical face of the base;

at least a substantially L-shaped groove configured by a first groove formed in a direction perpendicular to the mounting face and a second groove formed in circumferential direction of a cylindrical face is formed on one of the first and second cylindrical face;

at least a protrusion which is to be engaged with the L-shaped groove is formed on the other of the first and second cylindrical face; and the lamp holding spring contacts the second engaging portion of the base for applying the force for restricting turning of the base in a second turning direction.

12. The lighting apparatus in accordance with claim 10, wherein the lamp holder further comprises at least a temporary lamp holding spring for temporarily holding the base of the lamp when the first mounting face of the lamp holder and the second mounting face of the base are contacted; and the lamp holding spring and the temporary lamp holding spring are integrally formed on the same cantilever spring.

13. The lighting apparatus in accordance with claim 12, wherein the cantilever spring is held at an end of the temporary lamp holding spring on a base plate.

14. The lighting apparatus in accordance with claim 12, wherein the temporary lamp holding spring applies a force to the second engaging portion of the base for turning the base with respect to the lamp holder in the first turning direction so that the second engaging portion of the base is partially engaged with the first engaging portion of the lamp holder, when the first mounting face of the lamp holder and the second mounting face of the base are contacted.

15. The lighting apparatus in accordance with claim 12, wherein the lamp holder further comprising a first cylindrical face, which faces a second cylindrical face of the base;

at least a substantially L-shaped groove configured by a first groove formed in a direction perpendicular to the mounting face and a second groove formed in circumferential direction of a cylindrical face is formed on one of the first and second cylindrical face;

at least a protrusion which is to be engaged with the L-shaped groove is formed on the other of the first and second cylindrical face; and when the protrusion reaches to a position facing the second groove of the L-shaped groove, the temporary lamp holding spring applies a force to the second engaging portion of the base for turning the base with respect to the lamp holder in the first turning direction so that the protrusion proceeds into the second groove for temporarily holding the lamp on the lamp holder.

16. The lighting apparatus in accordance with claim 15, wherein the pushing force of the temporary lamp holding spring applied to the second engaging portion of the base is larger than that of the lamp holding spring.

17. The lighting apparatus in accordance with claim 10, wherein the base of the lamp has a plurality of pins disposed on a line and symmetrical to a center axis of the turning of the base with respect to the lamp holder;

the lamp holder has a plurality of lamp terminals disposed on a line to which the pins are electrically connected when the base is turned in the first turning direction at a predetermined angle with respect to the lamp holder; and a pair of the lamp holding springs is disposed on a line crossing at substantially right angle with the line on which the lamp terminals are disposed.

18. The lighting apparatus in accordance with claim 14, wherein the lamp holder further comprises a body and a cover for sealing an opening of the body; and the temporary lamp holding spring and the lamp holding spring are integrally formed with a coupler for coupling the body and the cover.

* * * * *

UNITED STATES PATENT AND TRADEMARK OFFICE

CERTIFICATE OF CORRECTION

PATENT NO. : 7,232,242 B2
APPLICATION NO. : 11/098468
DATED : June 19, 2007
INVENTOR(S) : Isoda et al.

It is certified that error appears in the above-identified patent and that said Letters Patent is hereby corrected as shown below:

At column 13, line 55 of the printed patent, "to the lamp holder In the first turning direction" should be --to the lamp holder in the first turning direction--

Signed and Sealed this

Twentieth Day of May, 2008

JON W. DUDAS
*Director of the United States Patent and Trademark Office*